US010072442B2

(12) United States Patent
Smith et al.

(10) Patent No.: US 10,072,442 B2
(45) Date of Patent: Sep. 11, 2018

(54) LATCHING ASSEMBLY

(71) Applicant: D & D Group Pty Ltd, Frenchs Forest, New South Wales (AU)

(72) Inventors: Glenn Smith, New South Wales (AU); James Novak, Queensland (AU)

(73) Assignee: D & D Group Pty Ltd, Frenchs Forest, New South Wales (AU)

( * ) Notice: Subject to any disclaimer, the term of this patent is extended or adjusted under 35 U.S.C. 154(b) by 182 days.

(21) Appl. No.: 14/768,464

(22) PCT Filed: Jan. 24, 2014

(86) PCT No.: PCT/AU2014/000047
§ 371 (c)(1),
(2) Date: Aug. 18, 2015

(87) PCT Pub. No.: WO2014/127398
PCT Pub. Date: Aug. 28, 2014

(65) Prior Publication Data

US 2016/0010361 A1 Jan. 14, 2016

Related U.S. Application Data

(60) Provisional application No. 61/767,163, filed on Feb. 20, 2013.

(30) Foreign Application Priority Data

Feb. 20, 2013 (AU) ..... 2013900575

(51) Int. Cl.
*E05B 65/00* (2006.01)
*E05B 41/00* (2006.01)
(Continued)

(52) U.S. Cl.
CPC ..... *E05B 65/0007* (2013.01); *E05B 15/00* (2013.01); *E05B 15/024* (2013.01);
(Continued)

(58) Field of Classification Search
CPC .. E05B 65/00; E05B 65/0014; E05B 65/0007; E05B 65/0052; E05B 65/0056;
(Continued)

(56) References Cited

U.S. PATENT DOCUMENTS 2,953,916 A * 9/1960 Thomas ..... E05B 65/0007 292/153
3,368,375 A 2/1968 Russell et al.
(Continued)

FOREIGN PATENT DOCUMENTS

AU 33799/89 11/1989
AU 2008202005 5/2008
(Continued)

OTHER PUBLICATIONS

Australian Patent Examination Report No. 2 for Application No. 2013202689 dated Aug. 15, 2016 (3 pages).
(Continued)

*Primary Examiner* — Suzanne L Barrett
(74) *Attorney, Agent, or Firm* — Michael Best & Friedrich LLP

(57) ABSTRACT

A latching assembly for a gate comprising: a latch operative to adopt a latched condition, the latch comprising one or more members coupled together, each latch member extending along a longitudinal axis; and a lock comprising a lock portion adjustable from a retracted to a projected configuration to bring the lock portion into engagement with the or at least one of the latch members in the projected configuration so as to lock the latch in its latched condition.

20 Claims, 20 Drawing Sheets

(51) Int. Cl.

| | |
|---|---|
| ***E05B 63/00*** | (2006.01) |
| ***E05C 1/04*** | (2006.01) |
| ***E05C 19/16*** | (2006.01) |
| ***E05B 15/02*** | (2006.01) |
| ***E05B 15/10*** | (2006.01) |
| ***E05B 17/04*** | (2006.01) |
| ***E05B 15/00*** | (2006.01) |
| ***E05B 27/00*** | (2006.01) |
| ***E05B 55/00*** | (2006.01) |
| ***E05B 61/00*** | (2006.01) |
| ***E05C 1/08*** | (2006.01) |

(52) U.S. Cl.
CPC ..... *E05B 15/101* (2013.01); *E05B 17/04* (2013.01); *E05B 27/00* (2013.01); *E05B 41/00* (2013.01); *E05B 55/00* (2013.01); *E05B 61/00* (2013.01); *E05B 63/0052* (2013.01); *E05B 63/0056* (2013.01); *E05B 65/0014* (2013.01); *E05C 1/04* (2013.01); *E05C 1/08* (2013.01); *E05C 19/163* (2013.01)

(58) Field of Classification Search
CPC ..... E05B 15/12; E05B 15/00; E05B 15/024; E05B 15/101; E05B 17/04; E05B 17/20; E05B 13/08; E05B 27/00; E05B 55/00; E05B 55/04; E05B 47/00; E05B 41/00; E05B 61/00; E05B 1/00; E05C 1/08; E05C 1/04; E05C 1/10; E05C 19/16; E05C 19/163
USPC ..... 70/100, 101, 432
See application file for complete search history.

(56) References Cited

U.S. PATENT DOCUMENTS

| | | | | |
|---|---|---|---|---|
| 3,416,805 | A * | 12/1968 | Morrison | G11B 17/16 369/209 |
| 3,503,642 | A | 3/1970 | Poe | |
| 4,389,062 | A | 6/1983 | Rosenberg | |
| 5,362,116 | A | 11/1994 | Doyle et al. | |
| 5,836,625 | A * | 11/1998 | Kibble | E05B 15/0053 292/145 |
| 6,047,577 | A * | 4/2000 | Klimas | E05B 35/08 70/340 |
| 6,171,313 | B1 * | 1/2001 | Razdolsky | A61B 17/666 433/7 |
| 6,938,445 | B2 | 9/2005 | Huang | |
| 7,216,517 | B2 * | 5/2007 | Ling | E05B 37/0034 70/21 |
| 7,357,007 | B2 * | 4/2008 | Lin | E05B 35/105 70/21 |
| 7,628,045 | B2 * | 12/2009 | Yu | E05L 337/025 70/21 |
| 8,011,212 | B2 * | 9/2011 | Yu | E05B 37/0034 70/21 |
| 8,376,421 | B2 * | 2/2013 | Simmonds | E05B 15/101 292/251.5 |
| 9,347,243 | B2 * | 5/2016 | Talpe | E05B 47/0001 |
| 9,451,998 | B2 * | 9/2016 | McBride | |
| 2001/0009105 | A1 * | 7/2001 | Clark | E05B 15/0093 70/101 |
| 2005/0199025 | A1 * | 9/2005 | West | E05B 19/04 70/277 |
| 2005/0210938 | A1 * | 9/2005 | Doyle | E05C 19/163 70/276 |
| 2005/0262902 | A1 * | 12/2005 | Ling | E05B 37/0034 70/21 |
| 2006/0103142 | A1 * | 5/2006 | Talpe | E05B 65/0007 292/164 |
| 2006/0283218 | A1 * | 12/2006 | Dolev | E05B 17/04 70/379 R |
| 2007/0113607 | A1 * | 5/2007 | Huang | E05B 39/00 70/432 |
| 2008/0295548 | A1 * | 12/2008 | Misner | E05B 35/105 70/21 |
| 2011/0016938 | A1 * | 1/2011 | Chi | E05L 341/00 70/432 |
| 2011/0193354 | A1 | 8/2011 | Simmonds | |
| 2014/0338475 | A1 * | 11/2014 | Lobo | F16K 31/53 74/30 |
| 2016/0003922 | A1 * | 1/2016 | Smith | E05B 47/02 324/207.13 |
| 2016/0060924 | A1 * | 3/2016 | Singh | E05B 65/0007 292/251.5 |

FOREIGN PATENT DOCUMENTS

| | | | |
|---|---|---|---|
| CN | 2068552 | U | 1/1991 |
| CN | 2331734 | Y | 8/1999 |
| CN | 201193417 | Y | 2/2009 |
| EP | 0651116 | | 5/1995 |
| GB | 2156892 | | 10/1985 |
| NL | 8005303 | A | 4/1982 |
| WO | WO-2008131398 | A1 | 10/2008 |
| WO | WO-2011088496 | A1 | 7/2011 |
| WO | WO-2011127310 | A1 | 10/2011 |
| WO | 2013026911 | | 2/2013 |

OTHER PUBLICATIONS

International Preliminary Report on Patentability for Application No. PCT/AU2014/000047 dated Jun. 22, 2015 (105 pages).
International Search Report for Application No. PCT/AU2014/000047 dated Apr. 22, 2014 (6 pages).
Australian Patent Examination Report for Application No. 2013202689 dated Nov. 27, 2014 (7 pages).
Australian Patent Examination Report No. 1 for Application No. 2014218491 dated Aug. 24, 2017 (4 pages).
Chinese Patent Office Action for Application No. 201480009282.X dated Dec. 6, 2016 with English Translation (11 pages).
European Search Report for Application No. 14754802.8 dated Feb. 9, 2017 (8 pages).

* cited by examiner

LATCHING ASSEMBLY

TECHNICAL FIELD

The present disclosure relates to latching assemblies associated with gates. The present disclosure also relates to locking assemblies for gate latches. The present disclosure also relates to the compliance of gate latching assemblies with the legal requirements for safety enclosures such as for pool fencing.

BACKGROUND TO THE DISCLOSURE

To prevent young children from entering particular areas such as a swimming pool area without supervision, safety enclosures are provided. In some cases, such as for swimming pools, fences are usually required by law. These safety enclosures generally include a self-latching assembly which is arranged to operate automatically on closing of the gate of the enclosure and prevents the gate from being reopened without manual release of the mechanism.

One form of such a self-latching device is a magnetic latching device, an example of which is described in WO92/03631.

The self-latching assembly may also be provided with a locking assembly to lock the self-latching assembly against manual releasing the device. Without the appropriate key to unlock the locking assembly, the latch cannot be released and the gate cannot be opened. This provides an additional level of safety to the enclosure.

SUMMARY OF THE DISCLOSURE

The present disclosure relates to improvements in various aspects of latching assemblies for the gates of safety enclosures such as pool fences.

According to one embodiment, the present disclosure provides a latching assembly for a gate comprising:

- a latch operative to adopt a latched condition, the latch comprising one or more members coupled together, each latch member extending along a longitudinal axis; and
- a lock comprising a lock portion adjustable from a retracted to a projected configuration to bring the lock portion into engagement with the or at least one of the latch members in the projected configuration so as to lock the latch in its latched condition.

According to another embodiment, the present disclosure provides a latching assembly for a gate comprising:

- a latch operative to adopt a latched condition, the latch comprising one or more members coupled together, each latch member extending along a longitudinal axis; and
- a housing for housing at least part of the latch; wherein
- the latch is operable to be released from its latched condition by moving the latch axially, wherein the or one of the latch members has at least one axially extending rib projecting from a portion of the latch member and the housing has a portion defining an axially extending recess that is shaped to receive the portion of the latch member having the at least one rib.

According to another embodiment, the present disclosure provides a latching assembly for a gate comprising:

- a latch operative to adopt a latched condition;
- a lock movable into a locking condition to lock the latch in its latched condition; and

- a lock status indicator which provides a visual indication of when the latch is locked in its latched condition, the lock status indicator having an indicator portion that is moved from a retracted configuration to a projected configuration by the movement of the lock to its locking condition, whereby the indicator portion when in its projected configuration provides the visual indication that the latch is locked in its latched condition.

According to another embodiment, the present disclosure provides a pool fence gate latching assembly, the assembly comprising:

- a latch operative to adopt a latched condition;
- a lock movable into a locking condition to lock the latch in its latched condition; and
- a lock status indicator which provides a visual indication of when the latch is locked in its latched condition.

According to another embodiment, the present disclosure provides a lock assembly for a gate latch comprising:

- a lock mechanism; and
- a housing for housing the lock mechanism, the lock mechanism configured with respect to the housing so that a key receiving opening is provided in an outer face of the housing through which a key is inserted to enable operation of the lock mechanism; wherein
- the housing comprises a lip on the outer face for directing liquid away from the opening.

According to another embodiment, the present disclosure provides a latching assembly for a gate comprising:

- a first component mountable to the gate and a second component mountable to a fixed element, the first and second components adapted to releasably engage one another in an engaged configuration to hold the gate in a fixed position with respect to the fixed element, wherein each of the first and second components are provided with at least one alignment indicator for indicating the correct alignment of each of the components with respect to the other when the components are to be engaging one another.

According to the above mentioned embodiment, the present disclosure also provides a method of assembling the latching assembly to a gate, the method comprising:

- mounting one of the first and second components to either of the gate or the fixed element;
- using the alignment indicators of each of the components to correctly align in an aligned position the other of the first and second components with respect to the component that has been mounted; and
- mounting the other of the first and second components in its aligned position to the other of the gate or the fixed element.

According to another embodiment, the present disclosure provides a tag for indicating that a latching assembly for the gate of a safety enclosure is compliant with legal requirements for the safety enclosure, the tag comprising:

- at least one coupling portion for coupling to a portion of the latching assembly that is associated with the pool fence gate; and
- indicia for indicating compliance with the legal requirements for the safety enclosure.

According to another embodiment, the present disclosure also provides a latching assembly for a gate of a safety enclosure comprising:

- a latch operative to adopt a latched condition;
- a housing for housing the latch; and the tag according to above mentioned embodiment for indicating that a pool fence gate latching assembly is compliant with legal requirements for the safety enclosure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF FIGURES

Embodiments of the disclosure will now be described by way of example only, with reference to the accompanying drawings in which:

In FIG. 4 the lock status indicator is indicating that the latch of the latching assembly is not locked and in FIG. 5 the lock status indicator is indicating that latch of the latching assembly is locked in its latched condition;

DETAILED DESCRIPTION OF EMBODIMENTS

Figure 1:
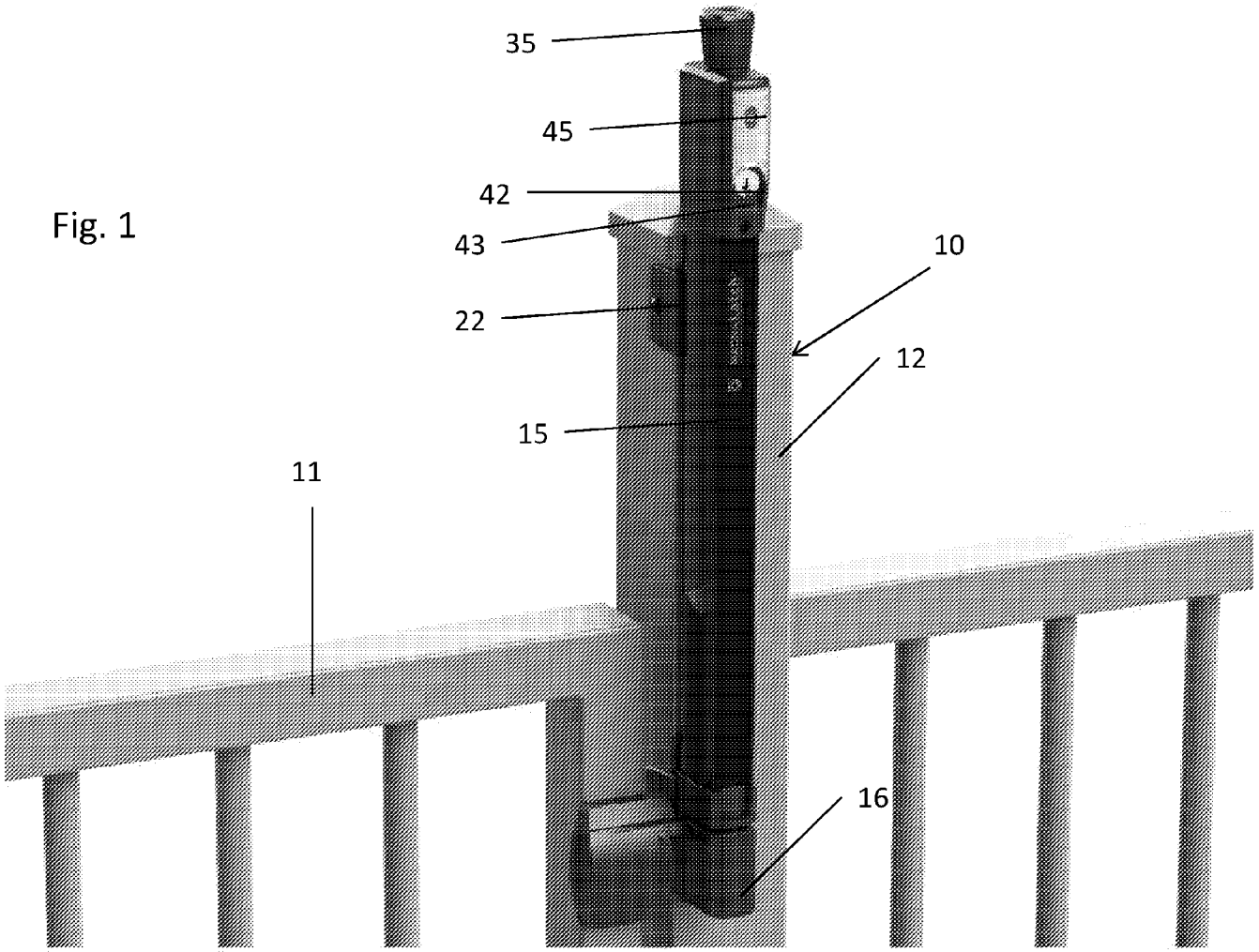
FIG. 1 is a perspective view of a latching assembly according to an embodiment of the present disclosure in use on a pool fencing gate, with the gate in a closed position.
Figure 3:
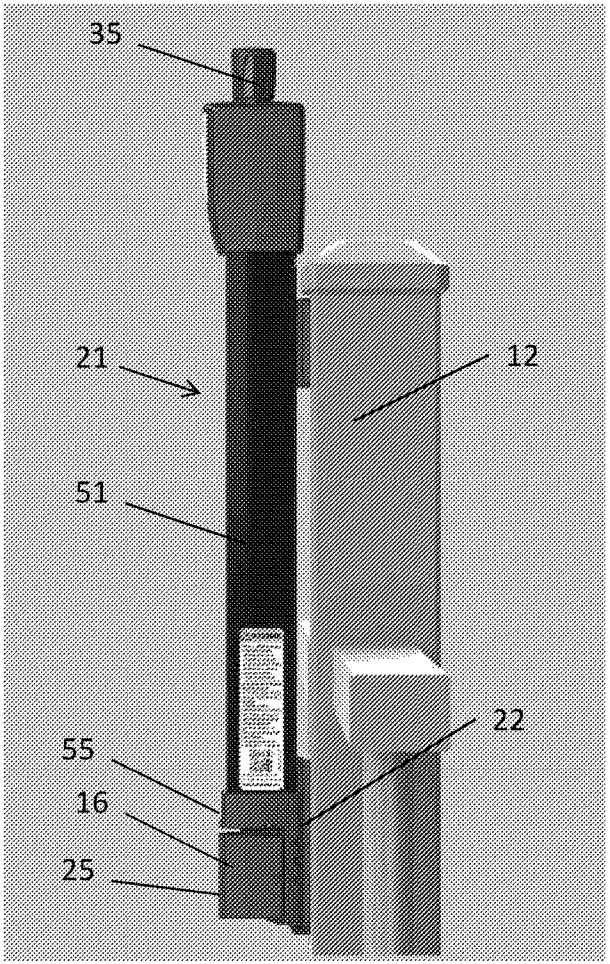
FIGS. 2 and 3 are front and side views respectively of the latching assembly of FIG. 1.
Figure 2:
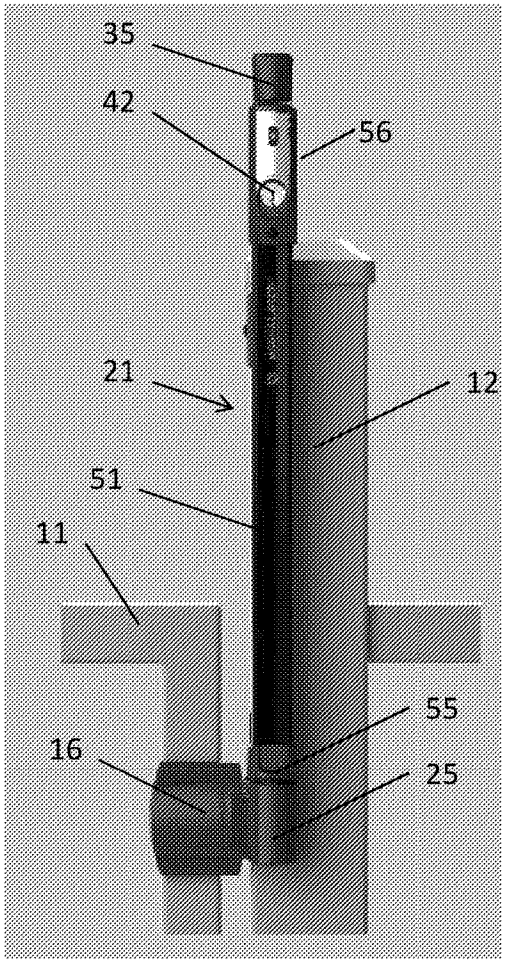

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilised, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The present disclosure relates generally to latching assemblies for gates. In the illustrated embodiment, the latching assembly is used to latch a gate such as that found in pool fencing or other safety enclosures A previous gate latch assembly is disclosed in PCT International Publication WO 92/03631 (WO '631). The assembly of WO '631 is particularly suitable for pool fencing and other safety enclosures and utilises magnetic force to affect operation of the latch.

The latch assembly in WO '631 comprises a latch comprising a latching pin mounted within a latch housing and movable between a retracted (unlatched) and an extended (latched) position. The latch pin is biased into the retracted position. Normally the latch is attached to a gate post and is orientated so that the latch pin moves within the latch housing in a vertical direction. The latch operates in conjunction with a striker that forms part of the latch assembly and which is typically mounted on the gate. The striker comprises a recess which is arranged to receive the latch pin. A permanent magnet is also provided in the striker to draw the latching pin into the recess of the striker when the striker is moved into register with the latch (when the gate is moved to the closed position) so as to effect latching of the assembly to hold the gate closed.

It is to be appreciated that whilst embodiments of the present disclosure described herein involve modifications, additions and improvements in relation to the above described magnetic latching assembly, the embodiments could be applied to other magnetic and non-magnetic latching assemblies.

Disclosed in some embodiments is a latching assembly for a gate comprising:

a latch operative to adopt a latched condition, the latch comprising one or more members coupled together, each latch member extending along a longitudinal axis; and a lock comprising a lock portion adjustable from a retracted to a projected configuration to bring the lock portion into engagement with the or at least one of the latch members in the projected configuration so as to lock the latch in its latched condition.

In some embodiments, the lock comprises first and second lock members, the first member rotatable to adjust the second member from a retracted configuration to a projected configuration to engage the second member with the or at least one of the latch members in the second member's projected configuration so as to lock the latch in its latched condition.

In some embodiments, said rotation of the first lock member causes lateral displacement of the second lock member.

In some embodiments, the lock portion is moved between its retracted and projected configurations in a direction perpendicular to the longitudinal axis of the latch.

In some embodiments, the latch is released from its latched condition by moving the latch in the direction of its longitudinal axis.

In some embodiments, the or one of the latch members is provided with a slot for receiving the lock portion when the lock portion is in its projected configuration.

In some embodiments, when the lock portion is received in the slot, movement of the latch is limited in the direction of the latch's longitudinal axis.

In some embodiments, the slot is formed in a rib on the or one of the latch members.

In some embodiments, the slot divides the rib into first and second rib portions.

In some embodiments, the latch member on which the rib is formed is provided with a guide surface to the slot for guiding the lock portion into the slot as the member portion is brought into its projected configuration.

In some embodiments, the guide surface comprises a portion of an end surface of the rib.

In some embodiments, the guide surface is provided by a tapering of at least a portion of the rib towards the slot.

In some embodiments, the guide surface is cambered.

In some embodiments, the lock portion is biased towards its retracted configuration.

In some embodiments, the lock portion that is received in the slot in its projected configuration is a lip of a lock member.

In some embodiments, the lock comprises a lock status indicator which provides a visual indication of when the latch is locked in its latched condition.

In some embodiments, the lock status indicator comprises the end surface of a projecting nose of the lock member.

In some embodiments, the first lock member has a thread formation which engages the second lock member, whereby rotation of the first lock member causes its thread formation to move the second lock member between its retracted and projected configurations.

In some embodiments, the thread formation of the first lock member is a ridge which is received in a groove in the second lock member. It is to be understood that in other embodiments, the ridge of the first lock member could engage with a ridge on the second lock member or the thread formation of the first lock member could be a groove which receives a ridge on the second lock member.

In some embodiments, the first lock member comprises a cylindrical body and the thread formation is formed on an outer surface of the body.

In some embodiments, the latching assembly also comprises a housing for housing the lock.

In some embodiments, the housing has mounting portions for mounting the first and second lock members to the housing.

In some embodiments, the housing and the second lock member have interengaging groove and rail formations which guide movement of the second lock member between its retracted and projecting configurations.

In some embodiments, the second lock member is configured so that to move the second lock member from its retracted configuration to its extended configuration, the second lock member must overcome an initial resistance against movement.

In some embodiments, the initial resistance is provided by the engagement of at least one hook portion of the second lock member with an edge formed in the housing.

In some embodiments, each hook portion is provided on an arm extending from the second lock member.

In some embodiments, the edge formed on the internal surface of the housing is the edge of a boss.

In some embodiments, the lock comprises a key barrel that is rotated by operation of a key, wherein the first lock member is connected to the key barrel.

Disclosed in some embodiments is a latching assembly for a gate comprising:

a latch operative to adopt a latched condition, the latch comprising one or more members coupled together, each latch member extending along a longitudinal axis; and a housing for housing at least part of the latch; wherein the latch is operable to be released from its latched condition by moving the latch axially, wherein the or one of the latch members has at least one axially extending rib projecting from a portion of the latch member and the housing has a portion defining an axially extending recess that is shaped to receive the portion of the latch member having the at least one rib.

In some embodiments, the portion of the latch member has first and second ribs projecting from the arm, the first and second ribs extending from the latch member perpendicular to each other.

In some embodiments, the portion of the latch member has four ribs, each rib arranged around the latch member at 90° to each adjacent rib. In these embodiments, the portion of the arm may be considered to have a cruciform shape in cross-section.

In some embodiments, each rib comprises opposed side surfaces that extend from the latch member.

In some embodiments, the opposed side surfaces of each rib are substantially parallel to each other.

In some embodiments, each rib extends axially along the latch member.

In some embodiments, the recess in the housing comprises at least one channel, each channel for receiving a respective rib of the latch member.

In embodiments, where the arm comprises first and second ribs, the recess comprises first and second channels. In embodiments, where the arm comprises four ribs, the recess comprises four channels. In these four channel embodiments, the recess may be considered to have a cruciform shape in cross-section.

In some embodiments, each channel comprises opposed side walls extending from an end wall.

In some embodiments, the opposed side walls of each channel are substantially parallel to each other.

In embodiments where the recess comprises two or more channels, at least one of the side walls of each channel connects to one of the side walls of the adjacent channel, wherein the connected side walls are substantially perpendicular to each other.

In some embodiments, each of the opposed side walls of each channel have a spacing formation formed thereon for spacing the rib of the latch member received in that channel.

In some embodiments, each spacing formation comprises a ridge extending along a substantial portion of the length of the respective side wall of the respective channel.

In some embodiments, when the portion of the latch member having the least one rib is received in the recess in the housing, the side surfaces of each rib face respective side walls of the channel in which the rib is received.

In some embodiments, where the latch member has more than one rib and the recess more than one channel, one of the channels is wider than the other channels and one of the ribs has at least a portion that is wider than the other ribs, such that the rib with the wider portion can only be received in the wider channel.

In some embodiments, the or one of the latch members has a gripping portion for a user to grip to operate the latch.

In some embodiments, the at least one rib is proximate to the gripping portion.

In some embodiments, the gripping portion is a portion of the latch member having the at least one rib, the at least one rib extending along the latch member from the gripping portion.

In some embodiments, the recess formed in the housing for receiving the portion of the latch member having the at least one rib is located in an upper region of the housing.

In some embodiments, the recess formed in the housing for receiving the portion of the latch member having the at least one rib is formed in a projection extending from the top of the housing.

In some embodiments, the latching assembly also comprises a lock movable into a locking condition to lock the latch in its latched condition.

In some embodiments, the lock comprises first and second members, the first member rotatable to move the second member from a retracted configuration to a projected configuration to engage the second member with the or at least one of the latch members in the second member's projected configuration so as to lock the latch in its latched condition.

In some embodiments, the or at least one of the latch members is provided with a slot for receiving a portion of the second lock member when the second lock member is in its projected configuration.

In some embodiments, when the portion of the second lock member is received in the slot, movement of the latch is limited in the latch's longitudinal direction.

In some embodiments, the slot for receiving the portion of the second lock member is formed in one of the ribs on the or one of the latch members.

In some embodiments, the latch member is provided with a guide surface to the slot for guiding the portion of the second lock member into the slot as the second lock member is brought into its projected configuration.

In some embodiments, the guide surface comprises a portion of the upper surface of the rib in which the slot is formed.

In some embodiments, the guide surface is provided by a tapering of at least a portion of the rib in which the slot is formed towards the slot.

Disclosed in some embodiments is a latching assembly for a gate comprising a latch operative to adopt a latched condition; a lock movable into a locking condition to lock the latch in its latched condition; and a lock status indicator which provides a visual indication of when the latch is locked in its latched condition, the lock status indicator having an indicator portion that is moved from a retracted configuration to a projected configuration by the movement of the lock to its locking condition, whereby the indicator portion when in its projected configuration provides the visual indication that the latch is locked in its latched condition.

In some embodiments, the assembly comprises a housing in which the lock status indicator is retained. The lock in some embodiments may also be retained in the housing.

In some embodiments, the housing comprises a window through which the lock status indicator can be visually inspected.

Disclosed in some embodiments is that the indicator portion of the lock status indicator, when in its projected configuration, is proximate to the window such that it can be seen through the window and when in its retracted configuration is withdrawn from the window such that it cannot be seen through the window.

In some embodiments, the indicator portion has a coloured surface that can be viewed through the window when the indicator portion is in its projected configuration. In a particular form, the coloured surface is red.

Disclosed in some embodiments is that the lock status indicator comprises a body and the indicator portion comprises part of the body, wherein movement of the indicator portion between its retracted and projected configurations comprises movement of the body between a retracted position and a projected position.

Disclosed in other embodiments is that the lock status indicator comprises a body and the indicator portion comprises a member coupled to the body, wherein movement of the indicator portion from its retracted to its projected configurations comprises movement of the member away from the body.

In some embodiments, the lock comprises a lock member that is rotated by the movement of the lock into its locking condition, wherein said rotation of the lock member causes lateral displacement of the indicator portion of the lock status indicator.

In some embodiments, the lock comprises a key barrel that is rotated by operation of a key, wherein the lock member is connected to the key barrel.

In some embodiments, the lock member has a cam surface which engages the lock status indicator, whereby rotation of the lock member causes its cam surface to move the indicator portion into either its retracted or projected configuration.

In some embodiments, the lock member has a thread formation which engages the lock status indicator, whereby rotation of the lock member causes its thread formation to move the indicator portion between its retracted and projected configurations.

In some embodiments, the thread formation of the lock member is a ridge and the lock status indicator has a respective groove for engaging with the ridge of the lock member.

In some embodiments, the indicator portion is biased towards its retracted configuration.

Disclosed in some embodiments is a pool fence gate latching assembly, the assembly comprising a latch and a striker for receiving the latch in a latched condition, a lock movable into a locking condition to lock the latch in its latched condition and a lock status indicator which provides a visual indication of when the latch is locked in its latched condition.

Disclosed in some embodiments is a lock assembly for a gate latch comprising a lock mechanism, and a housing for housing the lock mechanism, the lock mechanism configured with respect to the housing so that a key receiving opening is provided in an outer face of the housing through which a key is inserted to enable operation of the lock mechanism, wherein the housing comprises a lip on the outer face for directing liquid away from the opening.

In some embodiments the lip is curved, preferably convexly, more preferably in a semi-circle.

In some embodiments, lip is located above the opening and extends around the sides of the opening.

In some embodiments, the lip is spaced outwardly of the opening in a direction away from the outer face of the housing.

In some embodiments, the lip comprises a bevelled edge, preferably bevelled inwardly towards the outer face of the housing. The lip may be bevelled at an angle of between 10° to 70°.

In some embodiments, the outer face of the housing has a recess and the key receiving opening is located in the recess.

In some embodiments, the lip comprises an end edge of a member that is attached to the outer face of the housing.

In some embodiments, the opening comprises the key slot of a key barrel.

Disclosed in some embodiments is a latching assembly for a gate comprising a latch operative to adopt a latched condition, and a lock assembly as described in any of the aforementioned embodiments.

Disclosed in some embodiments is a latching assembly for a gate comprising a first component mountable to the gate and a second component mountable to a fixed element, the first and second components adapted to releasably engage one another in an engaged configuration to hold the gate in a fixed position with respect to the fixed element, wherein each of the first and second components are provided with at least one alignment indicator for indicating the correct alignment of each of the components with respect to the other when the components are to be engaging one another.

In some embodiments, each alignment indicator on each component comprises one or more surface features on a body of that component. The surface features may be recesses or projections.

In some embodiments, each alignment indicator on each component is elongate so that the alignment indicators are axially aligned to indicate the correct alignment of the components.

In some embodiments, the alignment indicators are provided on the components to indicate horizontal alignment of the components.

In some embodiments, the alignment indicators are provided on the components to indicate vertical alignment of the components.

In some embodiments, the first and second components comprise a keeper and a striker.

Disclosed in some embodiments, is a method of assembling the latching assembly as disclosed in any one of the aforementioned embodiments to a gate, the method comprising: mounting one of the first and second components to either of the gate or the fixed element; using the alignment indicators of each of the components to correctly align in an aligned position the other of the first and second components with respect to the component that has been mounted; and mounting the other of the first and second components in its aligned position to the other of the gate or the fixed element.

Disclosed in some embodiments is a tag for indicating that a latching assembly for the gate of a safety enclosure is compliant with legal requirements for the safety enclosure, the tag comprising:

at least one coupling portion for coupling to a portion of the latching assembly that is associated with the pool fence gate; and indicia for indicating compliance with the legal requirements for the safety enclosure.

In some embodiments, the tag comprises a body and the coupling portions comprise first and second arms extending from the body.

In some embodiments, the indicia are provided on the tag body.

In some embodiments, the indicia comprises at least a portion of the tag body.

In some embodiments, each arm comprises a hook a portion for engaging a part of the latching assembly to couple the tag to the latching assembly.

In some embodiments, each arm is sufficiently flexible to enable deflection away from each other when coupling the tag to the latching assembly.

In some embodiments, at least one of the arms has an engagement surface for a tool to engage to deflect the arm and decouple the tag from the latching assembly.

In some embodiments, the arms extend from opposite ends of the body, substantially parallel to each other.

In some embodiments, each arm is a mirror of the other.

Disclosed in some embodiments is a latching assembly for a gate of a safety enclosure comprising:

a latch operative to adopt a latched condition;

a housing for housing the latch; and a tag for indicating that a pool fence gate latching assembly is compliant with legal requirements for the safety enclosure as disclosed in any one of the above embodiments.

In some embodiments, the tag is coupled to the latching assembly towards the top of the housing.

In some embodiments, the assembly also comprise a release mechanism which is manually operable to release the latch from its latched condition and the tag is coupled to the latching assembly close to the release mechanism.

In some embodiments, the release mechanism comprises a gripping portion for a user to grip.

In some embodiments, the tag is configured to be installed between the housing and the part of the barrier to which the housing is mounted.

In some embodiments, the latching assembly also comprises a bracket attachable to part of the barrier, to which the housing is configured to be mounted and to which the tag is configured to be coupled.

In some embodiments, the bracket comprises a rail portion for receipt in a groove portion of the housing to mount the housing to the bracket and the tag is configured to couple to the rail portion.

Referring to the Figures, an illustrative embodiment of a latching assembly 10 for gates is shown and will now be described.

The latching assembly 10 is shown installed for use on a safety enclosure gate 11 for example as incorporated into pool fencing or playground fencing. The latching assembly 10 is a magnetic type latching assembly, the operation of which is similar to that described above with respect to WO '631.

Figure 12:
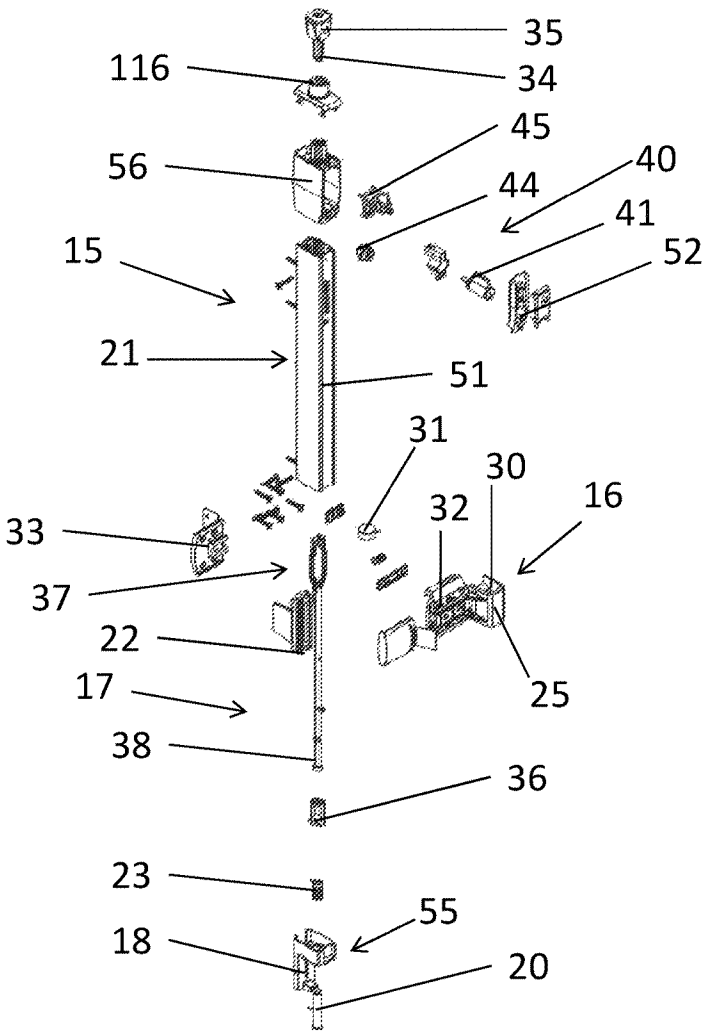
FIG. 12 is an exploded view of the latching assembly of FIG. 1.

The illustrated gate latching assembly 10 comprises a first component 15 mounted to a fixed post 12 of the safety enclosure fencing and a second component 16 mounted to the gate 11. The first and second components 15, 16 releasably engage to hold the gate 11 in a closed position as shown in FIG. 1 for example. The first component 15 provides the main latch structure of the latching assembly 10 (including the latch mechanism and keeper) and the second component 16 provides the striker of the latching assembly. FIG. 12 provides an exploded view of the first and second components of the gate latching assembly 10.

Although the Figures show an embodiment where the first latch component 15 is mounted to the fixed post 12 and the second component 16 is mounted to the gate 11, it is to be understood that the components 15, 16 could be mounted the other way around.

The first component 15 comprises a latch mechanism 17 incorporating a number of latch members coupled together to form a latch extending along a longitudinal axis, and a housing 21 containing at least a portion of the latch mechanism. One of the latch members is an elongate latching pin 20 housed within the housing 21. The housing 21 is mounted via mounting brackets 22 to the fixed post 12 and incorporates a keeper 18 disposed at a lower end of the housing 21 and which is arranged to receive the second (striker) component 16. A spring 23 which forms part of the latch mechanism provides an upward bias on the latching pin 20 so as to hold the pin in an upward position above the keeper when the latching pin is released from the second component and the gate 11 is opened, as will be described in further detail below.

The housing 21 of the first component 15 comprises a housing body 51, which in the illustrated embodiment is formed as an extruded section, and lower and upper housing end structures 55, 56 that are mounted to either end of the housing body 51.

The second component 16 comprises a body 25 having a retaining element in the form of a recess 30 within which is located a permanent magnet 31. The body 25 is mounted to the gate 11 via a mounting portion 32 that couples to a mounting bracket 33. The second component 16, when the gate 11 is closed as shown in FIG. 1, is received within the keeper 18 of the first component. In this configuration, the permanent magnet 31 acts on the latching pin 20 disposed within the housing 21 above the keeper 18, overcoming the bias of the spring 23 to draw the pin into the keeper 18 and into recess 30 of the striker 16 to capture the pin in the striker recess and thereby bring the latching pin into a latched condition.

To bring the latching pin 20 out of its latched condition (ie. into an unlatched condition) and enable the gate 11 to be opened, the latching mechanism 17 further comprises an actuator comprising a gripping portion for a user to grip in the form of a knob 35. The knob 35 is provided on the end of an arm 34, the opposed end of which is connected to the latching pin 20 via a link bar 38 of the latching mechanism 17. The arm 34 and the link bar 38 are further latch members of the latching mechanism and are configured, with the latching pin 20, to extend along the longitudinal axis. The knob 35 is located at and projects beyond the top of the housing 21. To open the gate 11, a user pulls the knob 35 upwards which raises the latching pin 20 out of the recess 30 in the body 25 and away from the magnet 31 which allows the gate to be opened. This usually requires a greater force (against that of the magnet) than can be applied by a small child, which in combination with the high location of the knob 35, enables the magnetic latching assembly to inhibit young children from entering the area inside the safety enclosure without supervision.

With the gate 11 open the biasing spring 23 holds the latching pin 20 in its now elevated position, even when the user lets go of the knob 35. Furthermore, the latch mechanism includes a lost motion arrangement incorporating a lost motion cage 36 which allows for the knob 35 to return to its rest position when the latching pin 20 is in its elevated position and also ensures that the weight of the upper portion 37 of the latch mechanism (which includes the knob 35 and link bar 38) does not bias the latch pin into lowered position which could otherwise prevent the latch from adopting its latched condition when the gate is closed. Further details of the lost motion arrangement are disclosed in WO '631, the contents of which are incorporated by cross reference.

When the gate 11 is swung back to its closed position, the striker body 25 containing the permanent magnet 31 is brought back into alignment with the latching pin 20 and automatically draws the pin down back into the recess 30 under the influence of the magnetic force provided by the magnet. As described above, the magnetic force is sufficiently great enough to overcome the bias provided by the spring 23 that holds the latching pin up when the gate is open. As a result the latching of the gate happens automatically upon closing.

The latching assembly 10 also comprises a key operated lock mechanism 40 for locking the latching pin 20 in its latched condition where it is retained in the recess 30 of the second striker component 16. The lock mechanism is also housed within the housing 21 of the first component. The lock mechanism 40 comprises a key barrel 41 having a key receiving opening 42 in an outer face 43 of the housing 21. Rotation of the key barrel 41 using the key brings the lock mechanism 40 into a locking condition where it engages with one of the latch members of the locking mechanism 17. More specifically, a first lock member 44 is rotated by rotation of the key barrel 41, which causes a second lock member 45 to move from a retracted configuration to a projected configuration where it engages the arm 34 extending from the knob 35. In this locking condition, the lock mechanism 40 prevents upward axial movement of the latch members including the latching pin 20 under manual operation of the knob 35 and thus locks the latching pin in its latched condition. In these conditions, the gate 11 cannot be unlatched and opened without the key to operate the lock mechanism 40, providing an additional level of safety in particular for pool fencing gates. This can be most important in security applications such as gates for swimming pools, playground areas and other safety enclosures designed to inhibit the unauthorised entry of young children. Further details of the components of the lock mechanism and its operation will be provided below.

Figure 5:
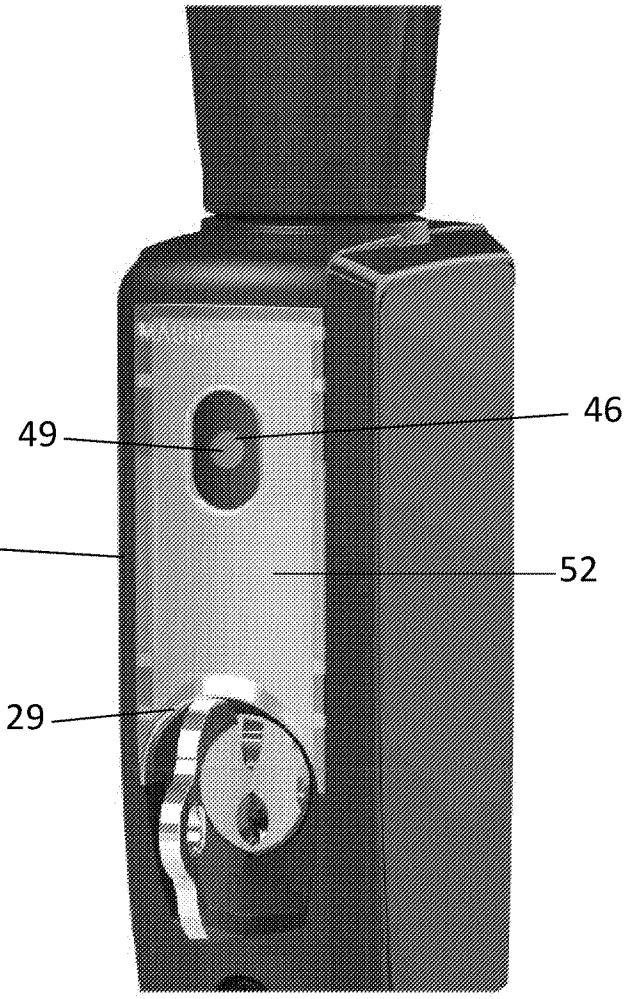
FIGS. 4 and 5 are detailed views of a part of the latching assembly of FIG. 1 demonstrating the operation of a lock status indicator of the latching assembly as viewed by a user.
Figure 4:
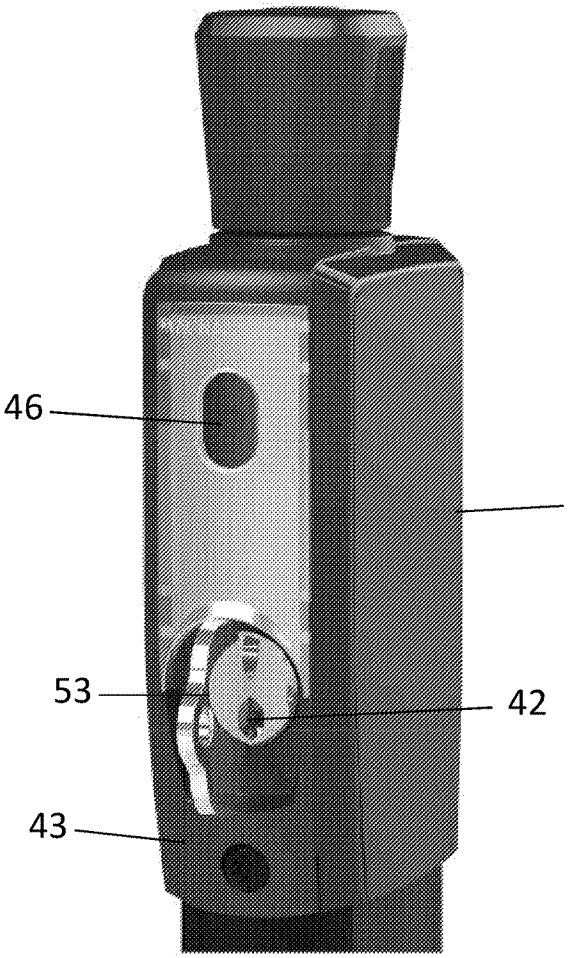
Figure 6:
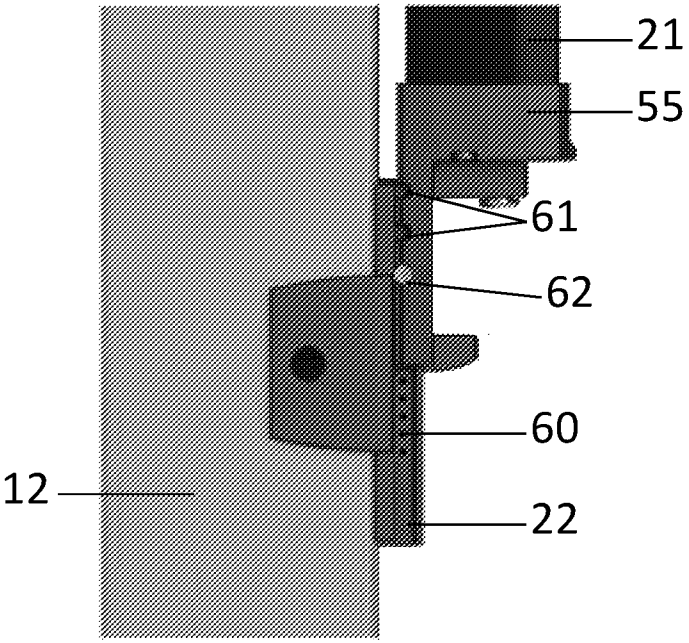

Referring in particular to FIGS. 4-6, the latching assembly 10 also comprises a lock status indicator, which in the illustrated embodiment is formed on the second lock member 45. The lock status indicator provides a visual indication of when the latching pin 20 is locked in its latched condition. The lock status indicator is located inside the housing 21, specifically the upper housing end structure 56. A window 46 is provided in the upper housing end structure 56 through which the lock status indicator can be viewed.

The lock status indicator comprises an indicator portion 48 of the second lock member 45. The indicator portion 48 has a coloured (preferably coloured red) end surface 49. FIG. 4 shows the latching assembly when the lock mechanism 40 is in an unlocking condition. In this instance the indicator portion 48 is in a retracted configuration where is end surface 49 is withdrawn from the window 46 in the upper housing end structure 56. In this configuration the indicator portion cannot be seen and this absence indicates that the lock mechanism is in an unlocking condition. In the illustrated form the window 46 is formed of a frosted translucent material and by virtue its optical characteristics the indicator portion 48 is clearly visible through the frosted window when it is located against or adjacent the window (in its projected position) but is obscured from view when it is in its retracted configuration. Accordingly movement of the indicator towards or away from the window has the effect of changing the indicator between on and off. This is achieved purely by mechanical means without requiring any electrical equipment.

FIG. 5 shows the latching assembly when the lock mechanism is in a locking condition. In this instance, the indicator portion 48 has been laterally displaced forwardly by the operation of the lock mechanism into its locking condition such that the end surface 49 of the indicator portion 48 is now proximate to and can be seen through the window 46. By providing this lock status indicator, a person can readily observe from a distance whether the latch of the latching assembly 10 has been locked in its latching condition. An adult can therefore be confident that a safety enclosure gate is secured against young children entering the enclosed area unsupervised without having to physically test whether the latch can be released from its latching assembly.

FIGS. 4 and 5 also show details of a lip 29 formed by an end edge of a plate member 52 that is attached to the outer face 43 of the upper housing end structure 56. The plate member 52 is inserted into a recess 53 formed in the outer face 43. The key receiving opening 42 of the lock mechanism 40 is flush with the surface defined in the outer face 43 by the recess 53. The plate member 52 and hence the lip 29 is located outwardly of the outer face 43 from the key receiving opening 42.

The purpose of the lip 29 is to protect the key receiving opening 42 from the ingress of any liquid, in particular water. In particular where the latching assembly 10 is used in connection with a swimming pool gate, water is will regularly run over the surface of the housing body 21. If the water gets into the key receiving opening it may corrode the lock mechanism 40. The lip 29 helps mitigate this by directing liquid away from key receiving opening 42.

The lip 29 achieves this, at least in part by having a semi-circular convex shape that curves from above the opening 42 around both sides of the opening. The lip 29 is also provided with an inward bevel at an angle of between 10 to 70 degrees. Alternatively, the bevel could be at an angle of between 20 to 45 degrees. Alternatively, the bevel could be at an angle of between 30 to 60 degrees. As a result a water droplet that runs down the outer face 43 of the upper housing end structure 56 from above the opening will, because of the surface tension in that water droplet, run along the lip 29 and be directed past the key receiving opening 42.

Figure 7:
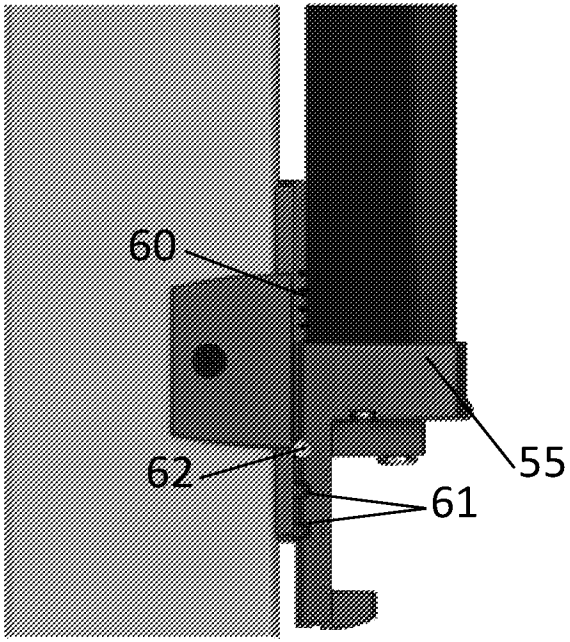
FIGS. 6 and 7 are side views of a lower part of the latching assembly of FIG. 1 which shows how the vertical mounting of the latching assembly can be adjusted (from its configuration in FIG. 6 to the configuration in FIG. 7)

Referring now to FIGS. 6 and 7, the mounting of the housing 21, specifically the lower housing end structure 55 to the lower mounting bracket 22 that is attached to the fixed post 12 is shown. In particular it is illustrated in FIG. 7 how the vertical positioning of the housing body 21 can be adjusted with respect to the mounting bracket 22. This provides greater flexibility in assembling the latching assembly 10 to gates of different heights as well as providing some tolerance in the attachment of the mounting bracket 22 to the fixed post 12.

In FIGS. 6 and 7 it can be seen that the mounting bracket 22 has a plurality of apertures 60 distributed along the length of the bracket and that the lower housing end structure 55 similarly has a plurality of slots 61. This enables a pin 62 to be selectively inserted through a particular aperture in the bracket and a particular slot in the lower housing end structure 55 to mount the body to the bracket. FIGS. 6 and 7 demonstrate how in this manner, the housing 21 can be mounted to the fixed post 12 at different vertical positions.

Referring now to FIGS. 8-11, it is shown in these Figures how alignment markings provided on each of the lower housing end structure 55 of the first latch component 15 and the second striker component 16 of the latching assembly 10 enable the keeper (which is incorporated into the lower housing end structure 55) and striker to be correctly aligned when installed in respect of a gate. The alignment markings are in the form of surface features on the first and second components 15, 16 (which in some instances take the form of a series of graduated markings) which enable ready visual inspection and adjustment based on this visual inspection, of the alignment of the components.

Figure 8:
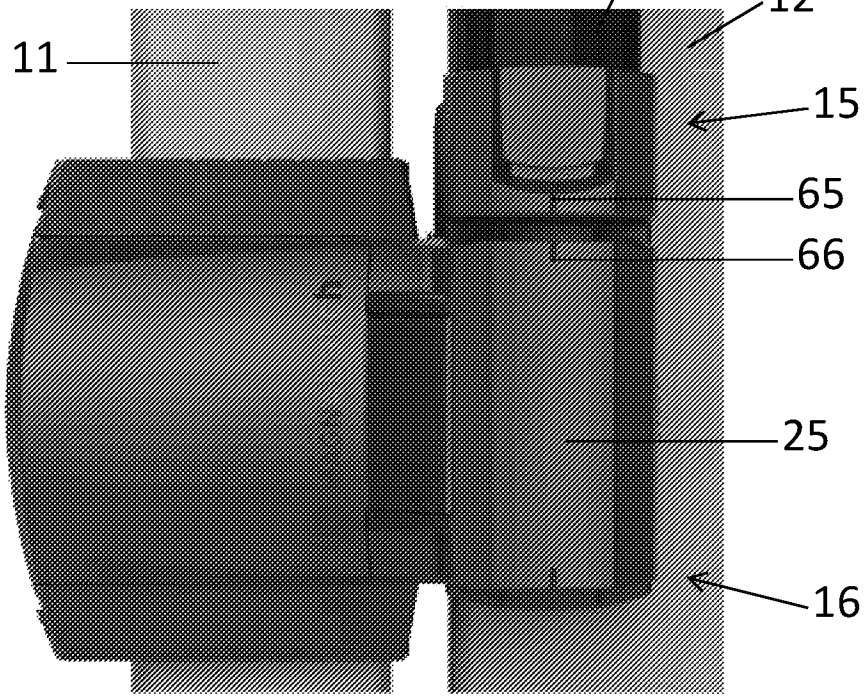
FIGS. 8, 9 and 10 are front views of a lower part of the latching assembly of FIG. 1 which shows how alignment markings on the keeper and striker of the latching assembly can be used to horizontally align the mounting of the keeper and the striker to the fence post and the gate respectively.
Figure 9:
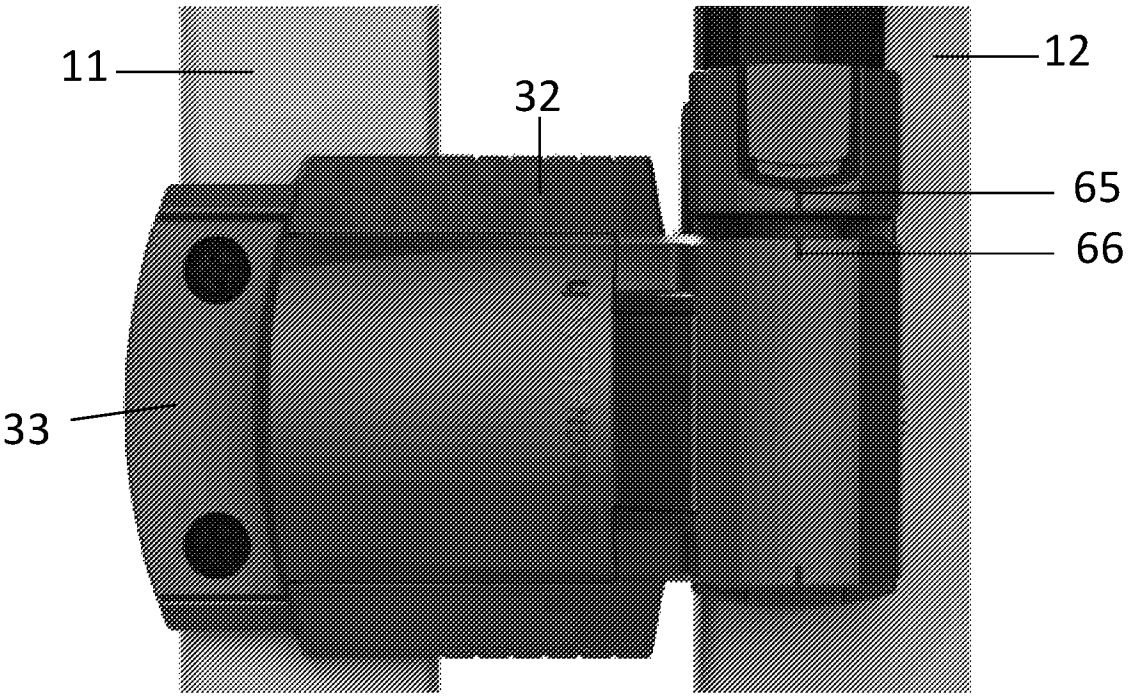

FIGS. 8 and 9 show in detail the alignment markings on the lower housing end structure 55 of the housing 21 and the striker body 25 which enable correct horizontal alignment of the first and second components 15, 16. The horizontal alignment markings comprise elongate lines 65 and 66 respectively, provided on the front surfaces of the lower housing end structure 55 and the striker body 25. When the lines 65, 66 are axially aligned then the lower housing end structure 55 and the striker body 25 of the respective latching assembly components are correctly aligned horizontally. FIGS. 8 and 9 can be compared to see how mounting of the latching assembly components can be adjusted so that they are in correct alignment despite significant variation in the spacing between the gate 11 and the fixed post 12. It is noted that although the elongate lines 65, 66 are provided in the form of the recessed grooves, they could be embossed projections on the surfaces of the lower housing end structure and/or the striker body respectively. The elongation of the alignment markings advantageously provides the user with perspective when aligning the alignment markings.

Figure 10:
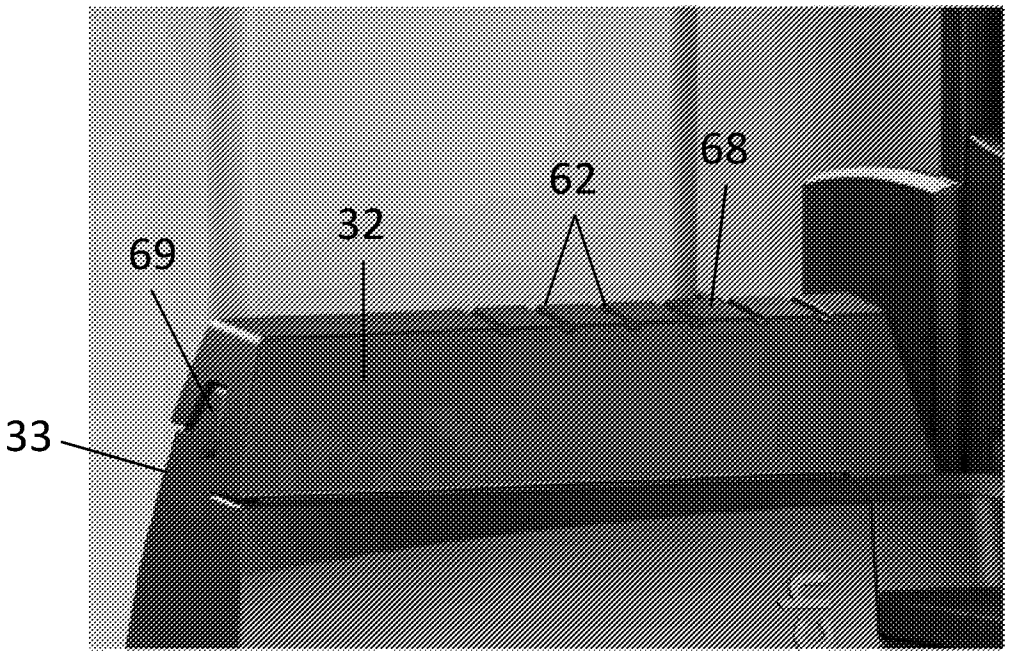

The mounting portion 32 of the striker body 25 is also provided with a plurality of equidistantly and horizontally spaced indicator markings 67 along an upper surface 68 of the mounting portion 32 (shown in detail in FIG. 10). The indicator markings 67 assist with the horizontal alignment of the striker body 25 by providing a correlation to the distance between the alignment lines 65, 66 on the lower housing end structure 55 and the striker body 25.

The mounting portion 32 is mounted to the mounting bracket 33 via a rail and groove arrangement 69. This enables the mounting portion 32 to readily slide over the mounting bracket 33 which has been fixed to the gate 11, when aligning the striker body 25 horizontally with the lower housing end structure 55. Once the correct alignment has been made, the mounting portion 32 is fixed with respect to the mounting bracket 33.

Figure 11:
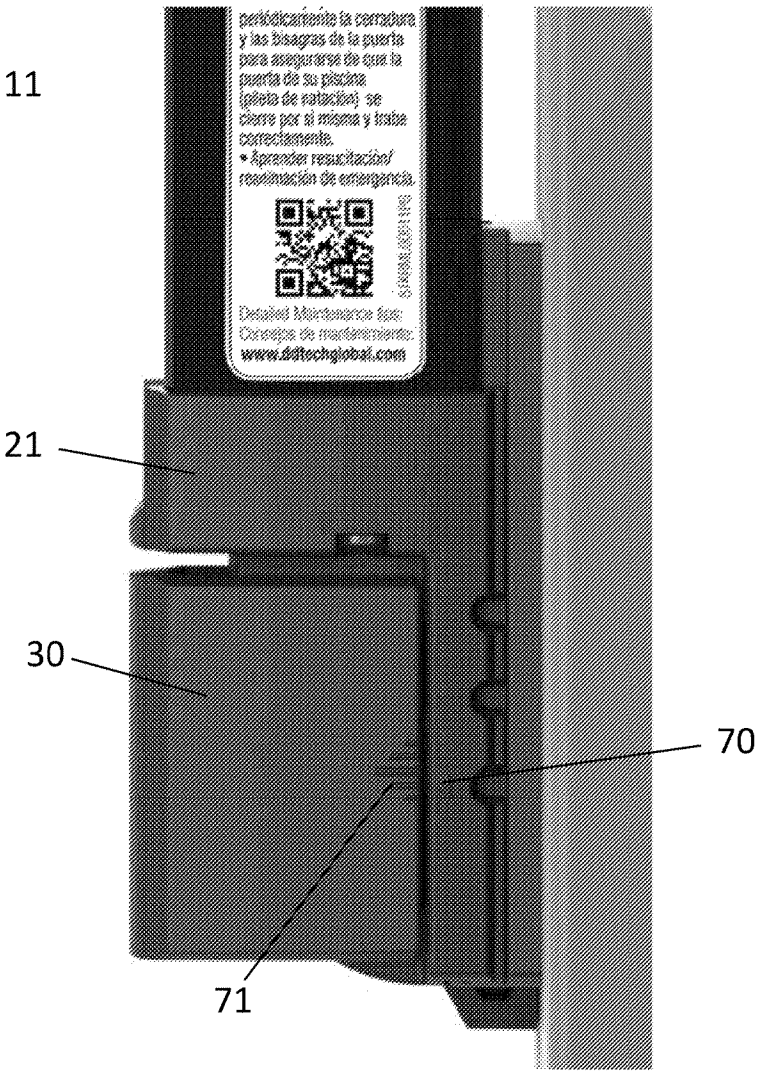
FIG. 11 is a side view of a lower part of the latching assembly of FIG. 1 which shows how alignment markings on the keeper and the striker can be used to vertically align the mounting of keeper and the striker to the fence post and the gate respectively.

FIG. 11 shows the alignment markings on the lower housing end structure 55 and the striker body 25 which enable correct vertical alignment of the first and second components 15, 16. The vertical alignment markings comprise a triangular shaped pointer 70 on the lower housing end structure 55 and a plurality of elongate lines 71 on the striker body 25. The vertical alignment markings are provided on side surfaces of the lower housing end structure 55 and the striker body 25. The vertical alignment of the latching assembly components 15, 16 does not need to be as accurate as the horizontal alignment. The components will be sufficiently vertically aligned when the apex of the pointer 70 is horizontally aligned with one of or between two of the elongate lines 71. The pointer 70 and the lines 71 may be recessed or projecting from the surface of lower housing end structure and the striker body respectively.

Referring now to FIGS. 12-16 and 21-23, further details of the latching assembly 10, in particular the latching mechanism 17 and the lock mechanism 40 are shown and will now be described.

As described above, the lock mechanism 40 comprises first and second lock members 44, 45. The first lock member 44 is shown in detail in FIG. 15. The first lock member 44 comprises a generally cylindrical body 100 with a helical thread projection 101 formed on the external surface of the body 100. The thread projection 101 extends partially around the body 100. The body 100 as at least one open end 102 to enable the first lock member 44 to be mounted to the housing end structure 56 of the gate latching assembly 10. The opposed end 113 of the body 100 is coupled to the key barrel 41 so that when the key barrel is rotated, the body of the first lock member is rotated.

Figure 16:
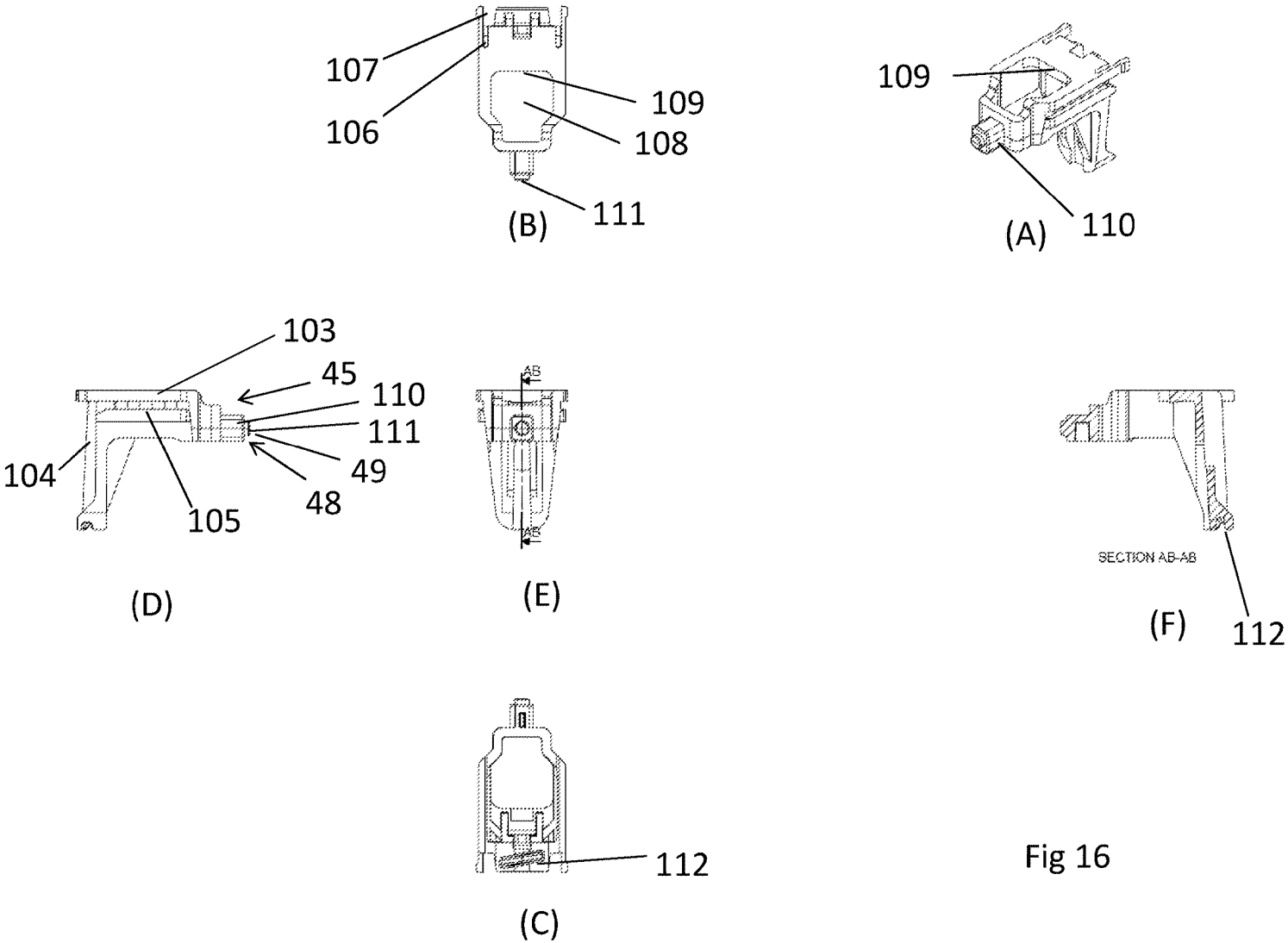
FIG. 16 is a series of views of a second lock member of the latching assembly, namely; (A) perspective, (B) top, (C) bottom, (D) side, (E) front and (F) cross-section through AB-AB views.
Figure 17:
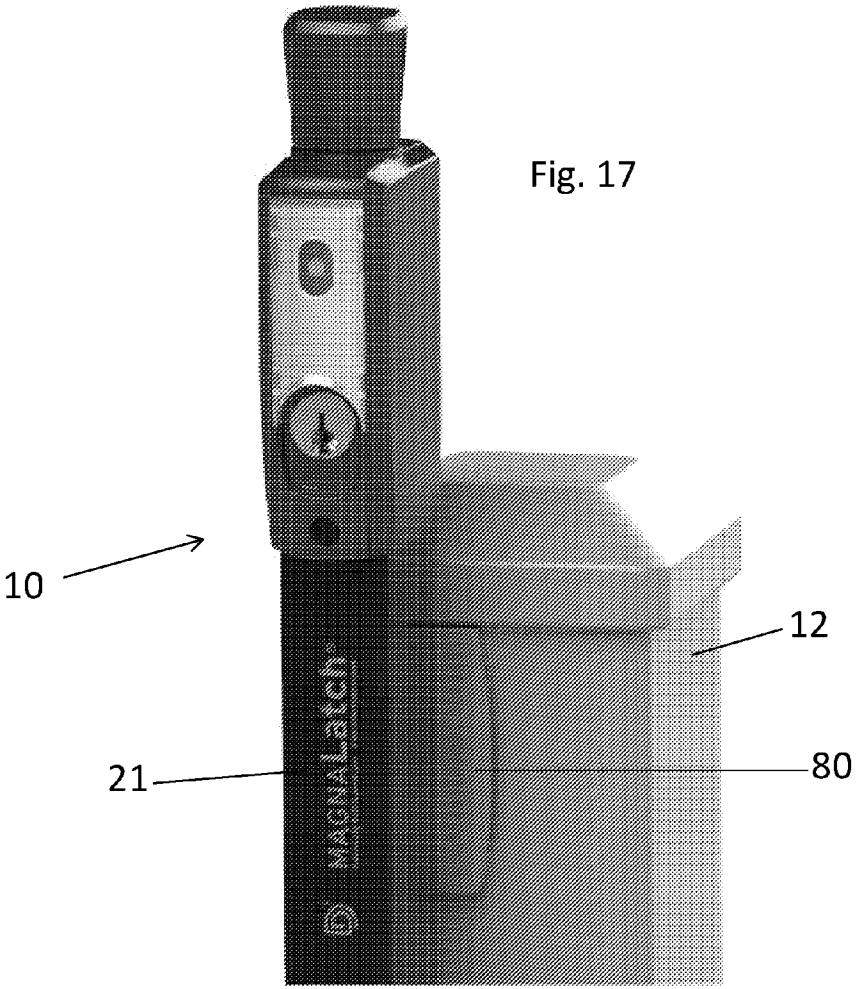
FIG. 17 is a perspective of the latching assembly of FIG. 1 which shows a tag for indicating that the latching assembly is compliant with local laws relating to pool fencing according to an embodiment of the present disclosure attached to the latching assembly.
Figure 18:
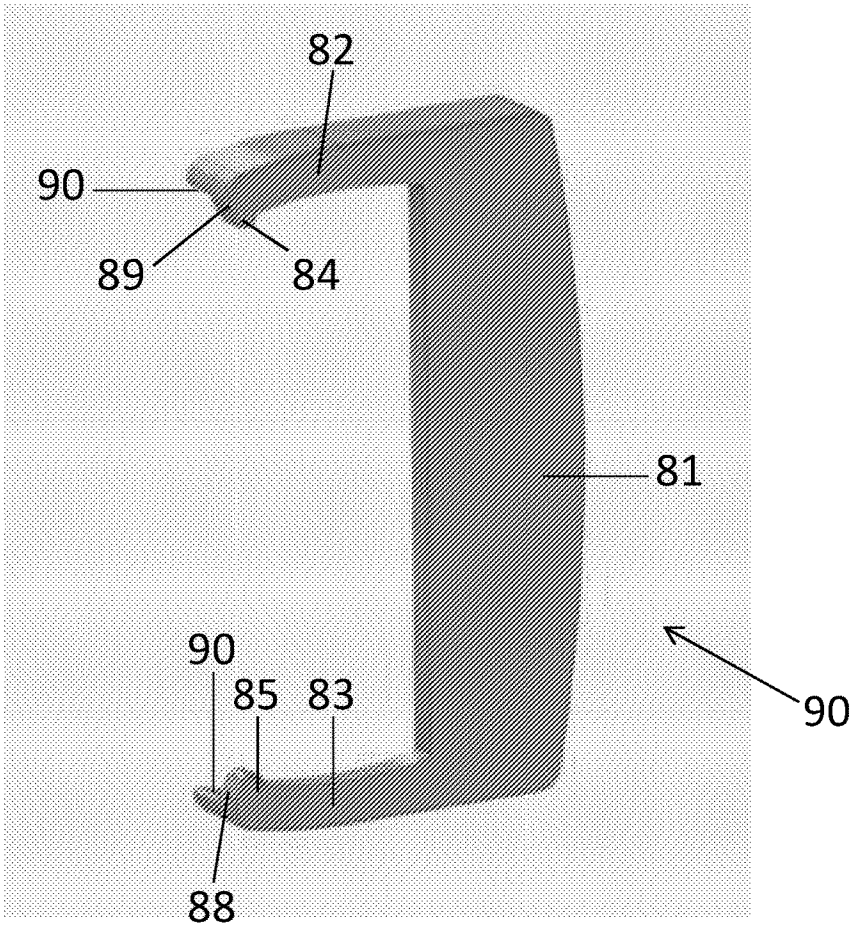
FIG. 18 is an isolated perspective view of the tag of FIG. 17.
Figure 19:
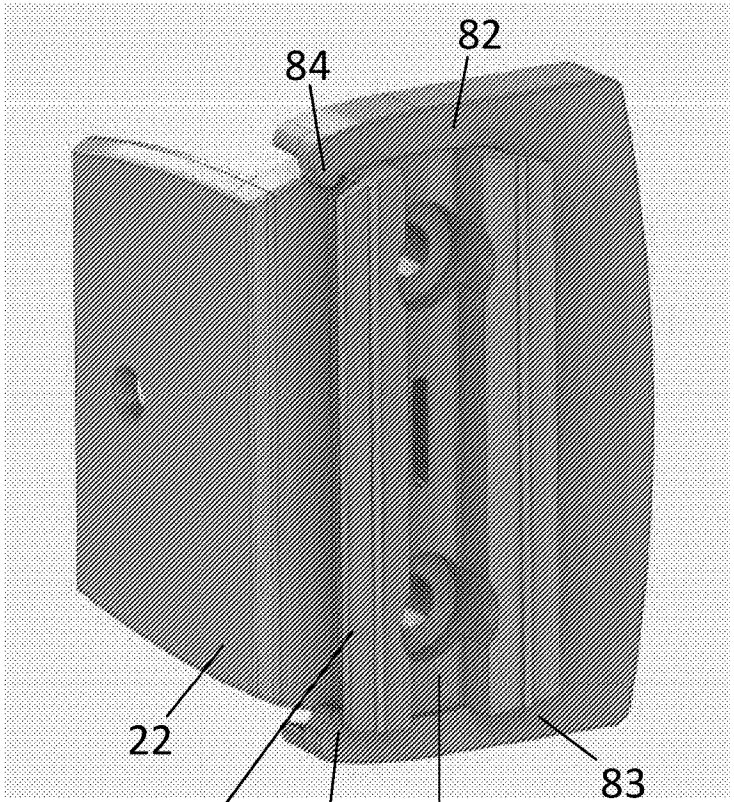
FIG. 19 is an isolated perspective view of the tag of FIG. 17 showing how the tag is attached to a bracket of the latching assembly.

The second lock member 45 is shown in detail in FIG. 16. The second lock member 45 is generally L-shaped having a first body portion 103 extending at right angles from a second body portion 104. When the gate latch assembly 10 is assembled, the first body portion 103 of the second lock member 45 is in a generally horizontal configuration and the second body portion 104 is in a generally vertical configuration. The first body portion 103 has grooves 105 formed in opposed sides for mounting the second lock member 45 to respective rails in the housing end structure 56 such that the second lock member 45 can slide between its retracted and projected configurations.

Arms 106 are provided on each side of the first body portion 103 of the second lock member 45 extending rearwardly of the grooves 105. Each arm 106 has a projection 107 at respective distal ends of the arm that forms a hook portion. An aperture 108 is provided through the first body portion 103, which at least in part defines a forward projecting lip 109 that is located within the second lock member 45. The purpose of these features will be described below.

Figure 15:
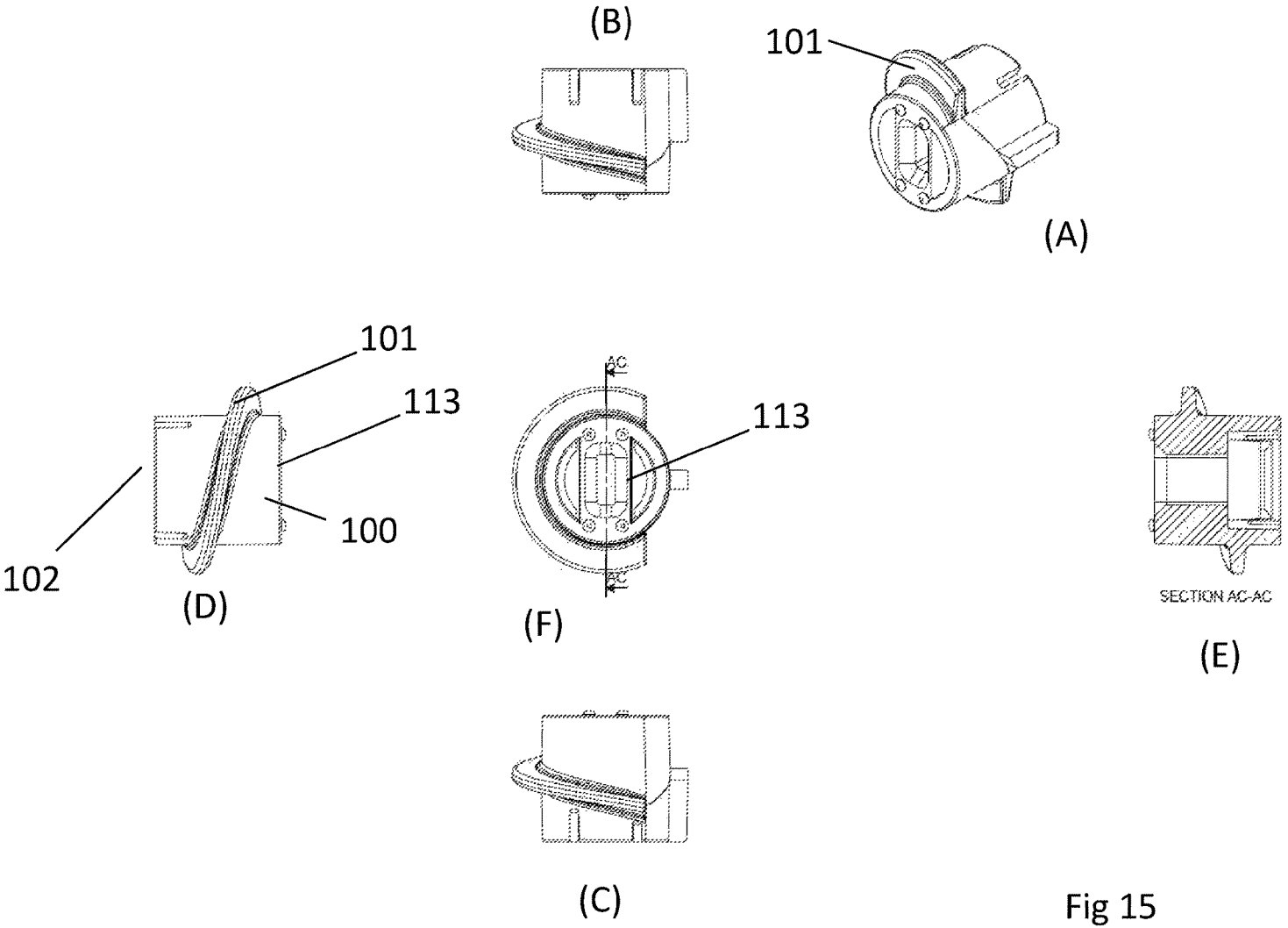
FIG. 15 is a series of views of a first lock member of the latching assembly, namely; (A) perspective, (B) top, (C) bottom, (D) left side, (E) right side, (F) front and (G) cross-section through AC-AC views.

Also, as previously described, a lock status indicator is formed on the second lock member 45 comprising an indicator portion 48, which in FIG. 15 is shown as a forwardly projecting nose 110 of the first body portion 103. The nose has a boss 111 formed thereon defining the end surface 49 that is brought into proximity with the window 46 in the upper housing end structure 56 to indicate when the lock mechanism 40 is locking the latch in its latched condition.

The second body portion 104 of the second lock member 45 is provided with a groove 112 at its distal end from the first portion 103. The groove 112 is shaped to receive the thread projection 101 of the first lock member 44. By this engagement of the thread projection 101 in the groove 112, rotation of the first lock member 44 will impart a translation force on the second lock member 45 to move the second lock member forward in the housing end structure 56 from its retracted configuration to its projected configuration. It is to be appreciated that although in the illustrated embodiment, the first lock member has a thread projection and the second lock member has a groove, other suitable formations may be provided on the lock members to enable a similar threaded engagement between the lock members. For example, the first lock member may have a thread groove in the external surface of its body which receives a projection on the second lock member or both the first and second lock members have thread projections which interengage.

Figure 13:
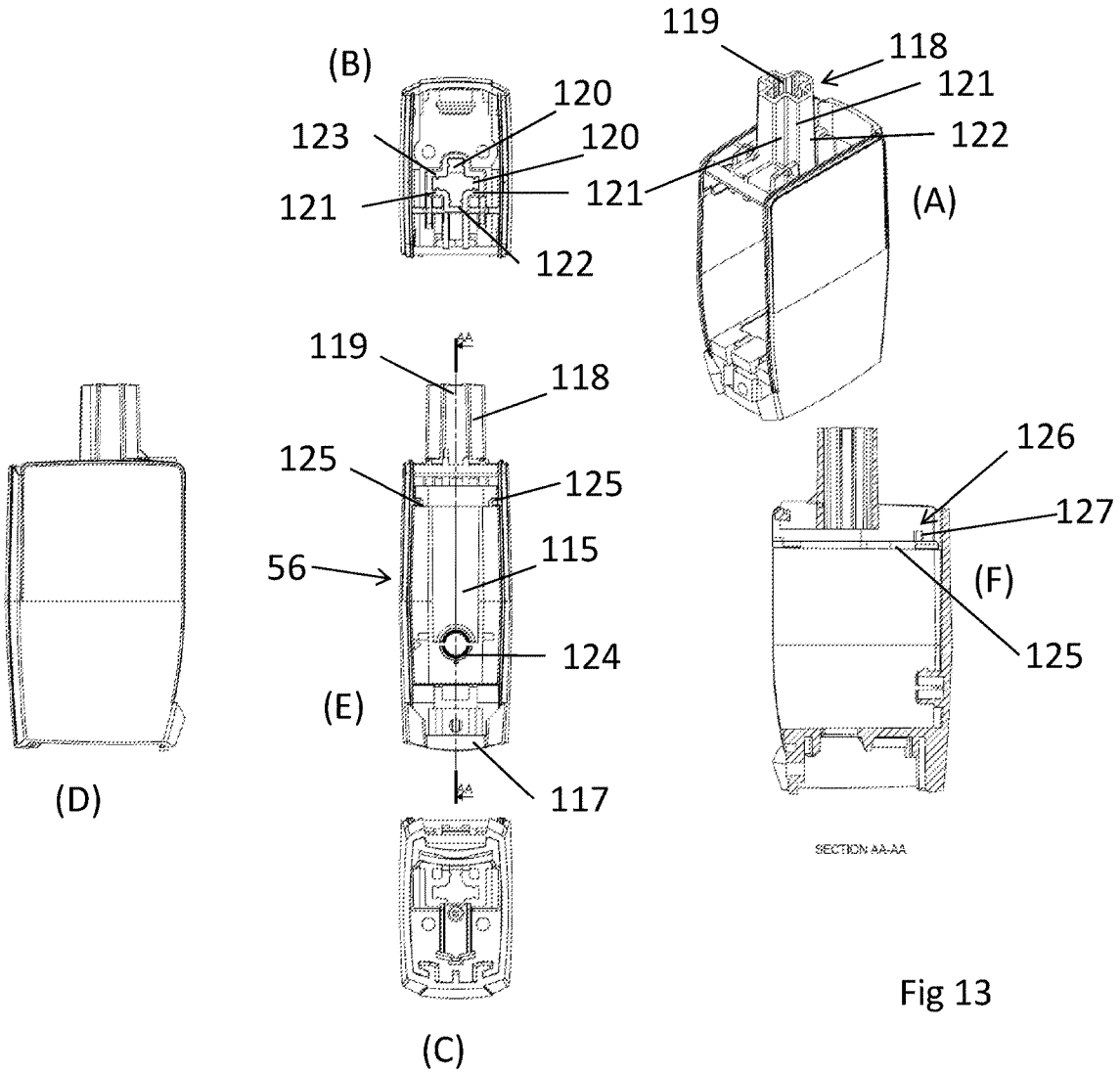
FIG. 13 is a series of views of an upper housing end structure of the latching assembly, namely; (A) perspective, (B) top, (C) bottom, (D) side, (E) front and (F) cross-section through AA-AA views.

The first and second lock members 44, 45 as well as the key barrel 41 of the lock mechanism 40 is housed within a cavity 115 formed within the upper housing end structure 56, as shown in more detail in FIG. 13. The cavity 115 and the end structure 56 in which it is formed are of a generally rectangular prism construction. FIG. 13 shows the upper housing end structure 56 without the plate member 52 attached to top front and a top plate member 116 attached to the top to close over the front and top of the end structure 56. The cavity 115 has an opening 117 through the bottom of the housing end structure 56. The bottom of the upper housing end structure, when the gate latching assembly 10 is assembled is attached to the top of the housing body 51 such that the cavity 115 of the end structure 56 is in communication with the cavity in the housing body 51.

A cruciform shaped projection 118 (in cross-section) extends from the top of the upper housing end structure 56. The projection 118 has an aperture 119 extending through the projection to open to the cavity 115. The aperture 119 is also of generally cruciform shape in cross-section, comprising four channels 120 extending from a mid portion of the aperture. Each of the channels 120 is defined by opposed side walls 121 extending from an end wall 122. The channel side walls 121 are each arranged at approximately 90° to the adjacent side wall of the adjacent channel so as to give the projection 118 and the aperture 119 its cruciform shape. Each channel side wall 121 is also provided with a ridge 123 extending along the length of the channel side wall. The aperture 119 extending through the projection 118 is shaped in this way to receive the correspondingly shaped arm 34 having the actuator knob 35 of the latching mechanism 17, as described below.

Projecting from a rear wall of the upper housing end structure 56, towards the bottom of the end structure, is a spigot formation 124 which is shaped to receive the open end 102 of the first lock member 44 so as to mount the first lock member to the housing end structure. The spigot 124 is also shaped so that when the first lock member 44 is mounted thereto, it is able to rotate. It is to be understood that in other embodiments to those illustrated, other rotatable mounting arrangements could be provided to mount the first lock member 44 to the housing end structure 56. For example, the first lock member could be provided with a projection that is received in a recess formed in the upper housing end structure.

Projecting from opposed side walls of the upper housing end structure 56, towards the top of the end structure, are rails 125. The rails 125 are shaped to receive respective grooves 105 formed in the second lock member 45 so as to slidably mount the second lock member 45 to the housing end structure 56. It is to be understood that in other embodiments to those illustrated, other sliding engagement structures could be provided to mount the second lock member 45 to the housing end structure 56. For example the second lock member could be provided with rails that are received in grooves in the second lock member or on top of rails.

At a rear region of each side wall of the upper housing end structure 56, above the respective rail 125 on that wall, there is provided a boss 126 (see in particular FIG. 13(F)). Each boss 126 defines an edge 127 which, when the second lock member 45 is mounted to the upper housing end structure 56 in its retracted configuration, is located in front of the second lock member's respective hook portions provided by the projections 107 at the end of each arm 106. When the second lock member 45 is adjusted from its retracted configuration to its projected configuration, the projections 107 on each arm 106 must move past the boss edge 127. In doing so, the projections engage respective boss edges 127 and require each arm 106 to flex in order to overcome this engagement and slip past the boss edges 127. This arrangement thus provides an initial resistance to movement of the second lock member 45 from its retracted configuration to its projected configuration and hence mitigates the risk of the second lock member 45 doing so inadvertently. Inadvertent movement of the second lock member could jam the lock and/or latching mechanisms and/or result in the lock status indicator falsely indicating that the latching mechanism is locked in its latched condition.

Figure 14:
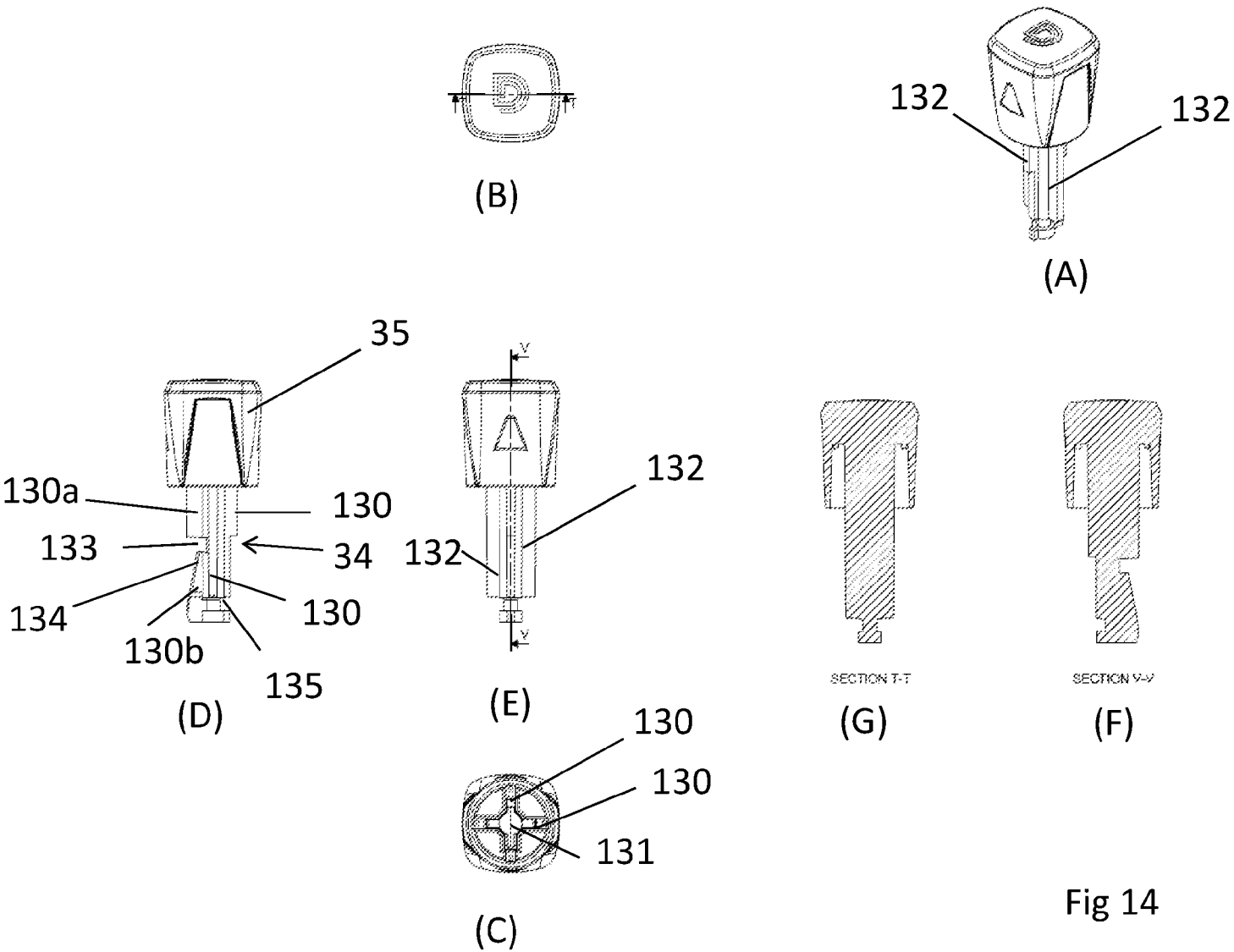
FIG. 14 is a series of views of a latch member arm and knob of the latching assembly, namely; (A) perspective, (B) top, (C) bottom, (D) side, (E) front, (F) cross-section through V-V and (G) cross-section through T-T views.

Referring in particular to FIG. 14, the arm 34 having actuator knob 35 is shown in greater detail. The arm 34 has four ribs 130 extending from a mid portion 131 and along the length of the arm 34. Each rib is arranged around the mid portion of the arm at approximately 90° to the adjacent rib such that, as shown in FIG. 14(C), the arm has a generally cruciform shape in cross-section. When the gate latching assembly 10 is assembled, the arm 34 is inserted through and partly located in the aperture 119 in the projection 118, with the knob 35 in it's at rest position sitting on top of the projection 118. When so assembled, the ribs 130 are each received in a respective channel 120 of the aperture 119, each rib and and channel extending parallel to the longitudinal axis of the latch members with the side walls 132 of each of the ribs 130 facing respective channel side walls 121. The ridges 123 that are provided on each of the channel side walls 121 ensure that the side walls 132 of each of the ribs 130 are generally spaced away from the channel side walls 121. This is so that movement of the arm 34 within the aperture 119 when operating the actuator knob 35 to axially move the latching pin 20 coupled to the arm 34 (via link bar 38) out of its latching condition is smooth and substantially frictionless.

The receipt of the ribs 130 on the arm 34 within respective channels 120 of the aperture 119 provides latching mechanism 17 of the gate latching assembly 10 with significant robustness. This is particularly important for when the latching pin 20 is being moved out of its latching condition, as significant forces are applied to the latch members coupled to the latching pin in particular the arm 34 which has the actuator knob 35 at its end. On occasion, these forces will be transverse to the longitudinal axis of the latch members (because a user is gripping the actuator knob 35 from a position to the side of the gate latching assembly 10). The ribs 130 and channel side walls 121 will, advantageously, transmit these transverse forces and reduce the likelihood that the arm 34 or other latch members will be damaged or broken during use.

It is to be understood that although in the illustrated embodiment, the arm is provided with four ribs and the aperture is correspondingly formed with four channels, less or more ribs and channels could be employed to increase the robustness of the latching mechanism.

It is also to be understood that although in the illustrated embodiments the ribs are provided on the arm 34 and the aperture is formed with the channels in the projection from the top of the upper housing end structure, alternatively or additionally, similar ribs could be provided on portions of the other latch members in the latching mechanism, such as the link bar 38 and correspondingly shaped apertures having channels through which the latch members are received could be provided in other components of the housing 21 of the gate latching assembly 10.

One of the ribs on the arm 34 has a recess 133 formed therein. The recess 133 divides the ribs into upper and lower rib portions 130*a*, 130*b*. The lower rib portion 130*b* is tapered towards the recess 133 and its end surface 134 is cambered. A coupling portion 135 is provided at the opposed end of the arm 34 to the actuator knob 35 for coupling to the link bar 38.

When the gate latching assembly 10 is assembled, the arm 34 extends through aperture 119 in the projection 118 and into the cavity 115 in the upper housing end structure 56. In doing so, the arm 34 also extends through the aperture 108 formed in the first body portion 103 of the second lock member 45 that is mounted to the housing end structure 56. The arm 34 is oriented so that, when it is at rest position, the recess 133 is facing toward the lip 109 of the second lock member 45. To ensure that the arm 34 is correctly orientated during assembly, the rib 130 in which the recess 13 is formed is wider than the other ribs and the corresponding channel 120 in which that rib is to be received is also wider than the other channels.

Figure 22:
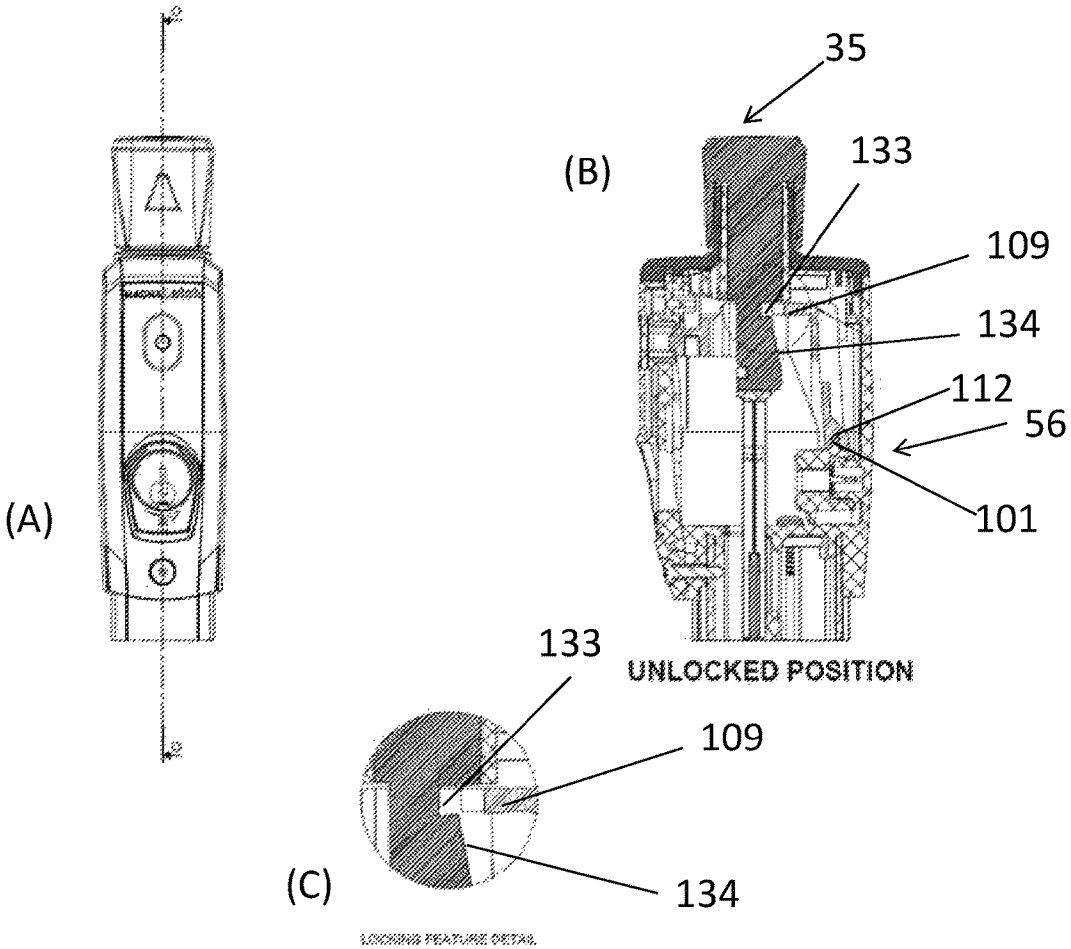
FIG. 22 is a series of views of part of the latching assembly of FIG. 1 showing the lock mechanism of FIG. 21 in the unlocked configuration where the latch is not locked in its latched condition, namely; (A) a front view, (B) a cross-sectional view through O-O and (C) a magnified view of a part of FIG. 22(B)
Figure 23:
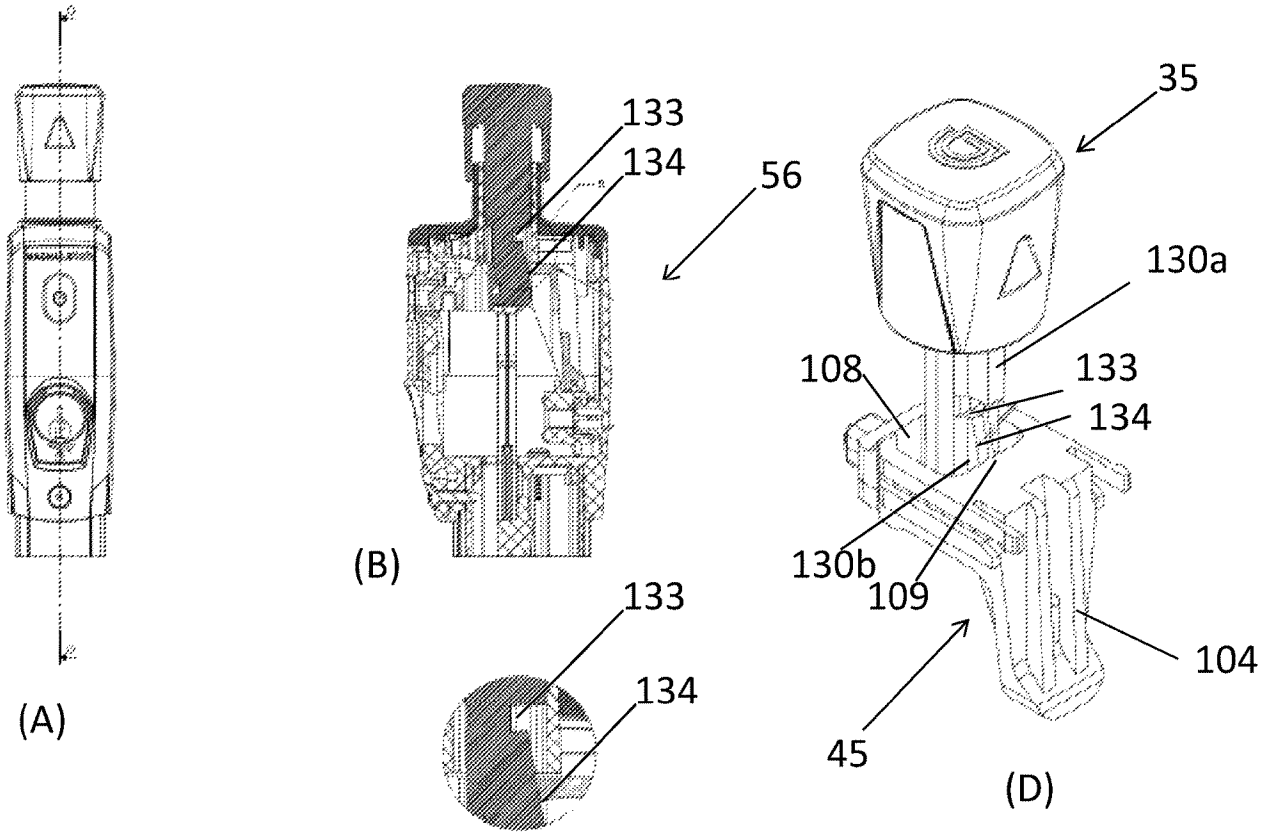
FIG. 23 is a series of views of the latching assembly of FIG. 1 showing the configuration of components of the latching assembly when an actuator in the form of a knob is operated to unlatch the latch of the latching assembly from its latch condition, namely; (A) a front view, (B) a cross-section view O-O, (C) a magnified view of a part of FIGS. 23(B) and (D) a rear perspective view of the relative positions of the actuator and the second lock member of the lock mechanism.

Referring in particular to FIG. 22, when the second lock member 45 is in its retracted configuration, the lip 109 is spaced from the recess 133 in the arm 34. In this configuration, the second lock member 45 is free from any engagement with the arm 34 such that the arm and the latch members connected to the arm including the latching pin 20 via link bar 38, are free to move axially in order to unlatch the latching mechanism 17.

Figure 21:
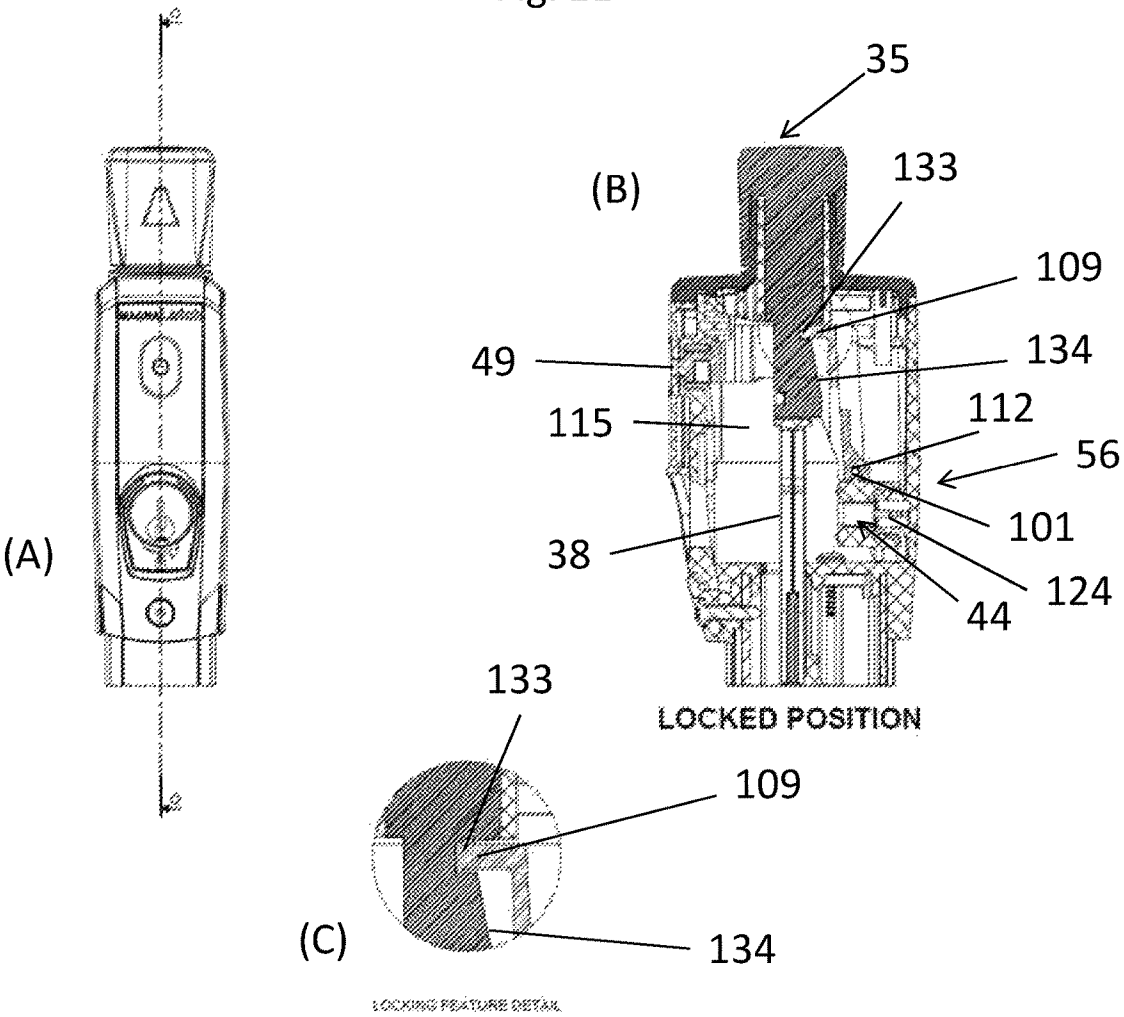
FIG. 21 is a series of views of part of the latching assembly of FIG. 1 showing a lock mechanism locking the latch of the latching assembly in its latched condition, namely; (A) a front view, (B) a cross-sectional view through O-O and (C) a magnified view of a part of FIG. 21(B)

Referring in particular to FIG. 21, when the second lock member 45 is brought into its projected configuration by rotation of the first lock member 44 under operation of the key barrel 41, the lip 109 of the second lock member is moved forwardly to be received in the recess 133 in the arm 34. This engages the second lock member with the arm 34 and limits axial movement of the arm 34. As a result, the latching pin 20 connected to the arm via link bar 38 is locked against moving axially out of its latching condition.

Advantageously, should there be a partial misalignment between the lip 109 and the recess 133 when the second lock member 45 is in its retracted configuration, the tapered and cambered end surface 134 of the lower rib portion 130*b* in which the recess 133 is formed provides a guide surface for guiding the lip 109 into the recess as the second lock member 45 is brought into its projected configuration. The camber of the surface 134 reduces the contact pressure should the lip 109 engage and slip over this surface and into the recess 133.

Referring now to FIGS. 17-20, a tag 80 for indicating that the latching assembly 10 is compliant with legal requirements for the safety enclosure is shown attached to the latching assembly. The tag 80 is particularly useful for indicating compliance with legal requirements for providing fencing around swimming pools. The tag 80 comprises a body 81 on which is provided one or more indicia that indicates legal compliance. For example, the indicia may include the name of the local council, city or state and an individual identifier code, specific to that tag 80. The tag body 80 is also formed of a bright colour so that it can be readily identified from a distance, the bright colour itself forming at least part of the indicia to indicate legal compliance.

FIGS. 14 and 15 show the details of how the tag 80 is attached to the latching assembly 10. The tag 80 is clipped to the upper mounting bracket 22 which is used to mount the first component 15 to the fence post 12. The tag could be clipped to other brackets or other parts of the latching assembly, however, by clipping the tag to the upper mounting bracket 22 the tag is positioned at an eye line level so that it can be easily identified by an adult.

Figure 20:
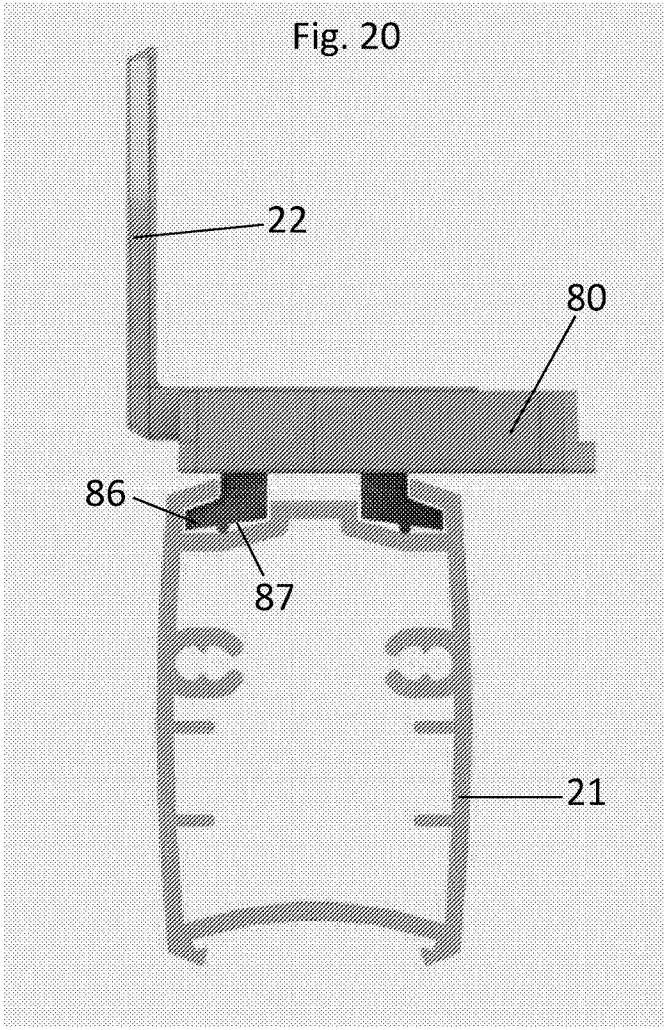
FIG. 20 is a top view of the tag of FIG. 17 and a latch housing body of the latching assembly shown mounted to the bracket.

The tag 80 comprises first and second arms 82, 83 which extend from opposite ends of the tag body 81 generally parallel to one another. The arms 82, 83 are mirror images of each other so that the tag 80 can be installed in an upside down configuration. Each arm 82, 83 has hook portions 84, 85 which hook over and engage opposite ends of a portion of the bracket 22 in order to connect the tag 80 to the bracket 22. That portion of the bracket 22 is a rail portion 86 which receives a groove portion 87 of the housing body 21 of the first component 15 (see FIG. 20). As can be seen in FIG. 20, the arms 82, 83 fit over the bracket 22, behind the housing body 21. The tag 80 is thus attached to the bracket 22 by pushing the arms 82, 83 over the bracket from the side (the arms being sufficiently flexible to deflect apart when so pushed). This can be done after the latching assembly 10 has been fully assembled, including the housing body 21 being mounted to the bracket 22. The arms 82, 83 of the tag are biased towards their at rest position, so that when the tag 80 has been pushed to the position shown in FIG. 19, the arms 'snap' back into the position shown with their respective hook portions 84, 85 engaging the rail portion 86. Each hook portion 84, 85 is provided with a ramp surface 88, which serve to deflect the arms 82, 83 away from each other when the ramp surfaces 88 engage the rail portions 86 of the bracket 22. This enables the arms 82, 83 to have clearance over the rail portions 86 when the tag 80 is being attached to the bracket. It also prevents the hook portions 84, 85 from getting caught in the space 89 between the two rail portions 86 of the bracket 22.

The arms 82, 83 of the tag 80 also have engagement surfaces 90 at their distal ends. The engagement surfaces 90 are formed as planar surfaces which are recessed in the arms. When the tag 80 is installed, the engagement surfaces 90 are each facing and spaced from respective edges 91 of the bracket 22. The engagement surfaces 90 enable the tag 80 to be removed from its attachment to the bracket 22, by providing a surface on which a tool, such as a screwdriver, can engage to lever and prise apart the arms 82, 83. Once the arms have been prised apart using the tool, the tag 80 can be easily pulled off the bracket. The edges 91 of the bracket 22 can be used as fulcrum points for the tool when carrying out the levering action to prise apart the arms.

It is to be understood that, if any prior art publication is referred to herein, such reference does not constitute an admission that the publication forms a part of the common general knowledge in the art, in Australia or any other country.

In the claims which follow and in the preceding disclosure, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the present disclosure.

Accordingly, the present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods which can, of course, vary. It is also to be understood that the terminology used herein is for the purpose of describing particular embodiments only, and is not intended to be limiting.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. A gate latch assembly arranged to be mounted to either a gate or a gate post and adapted to co-operate with a component mounted on the other of the gate or gate post to hold the gate closed, the gate latch assembly comprising:

a first component which is arranged to be mounted to the gate or the gate post and a second component arranged to be mounted on the other of the gate or the gate post;

the first component comprising a latch operative to adopt a latched condition, the latch extending along a longitudinal axis and comprising latch members coupled together extending along a longitudinal axis, the latch members include an actuator and a latching pin;

the latching pin being movable from an unlatched position to a latched position and is biased into the unlatched position, wherein when the first and second components are in juxtaposition in the closed position, the latch is arranged to adopt the latching condition by the latching pin being caused to be moved against the bias from the unlatched position to the latched position by magnetic attraction between the latching pin and a magnet of the second component wherein the latching pin establishes engagement with the second component;

the latching pin being movable from the latching position to the unlatched position under manual movement of the actuator along the longitudinal axis;

the latch further comprises a lock comprising first and second lock members, the first member is rotatable to adjust the second member from a retracted configuration to a projected configuration, and a lock portion adjustable from a retracted configuration to a projected configuration where the lock portion is arranged to engage with the actuator when the second lock member is in the projected configuration so as to lock the latch in its latched condition by limiting axial movement to prevent the latch from moving axially out of the latched condition under operation of the actuator, wherein the first lock member has a thread formation which engages the second lock member, whereby rotation of the first lock member causes the thread formation to move the second lock member between the retracted and projected configurations.

2. A gate latch assembly as claimed in claim 1, wherein the thread formation is helical.

3. A gate latch assembly as claimed in claim 1, wherein the thread formation of the first lock member comprises a thread projection which is received in a groove in the second lock member.

4. A gate latch assembly as claimed in claim 1, wherein the first lock member comprises a cylindrical body and the thread formation is formed on an outer surface of the body.

5. A gate latch assembly as claimed in claim 1, wherein the lock comprises a key barrel that is rotated by operation of a key, wherein the first lock member is connected to the key barrel.

6. A gate latch assembly as claimed in claim 1, wherein rotation of the first lock member causes the second lock member to translate.

7. A gate latch assembly as claimed in claim 1, wherein the second lock member is moved between its retracted and projected configurations in a direction perpendicular to the longitudinal axis of the latch and wherein the latch is released from its latched condition by moving the latch in the direction of its longitudinal axis.

8. A gate latch assembly as claimed in claim 1 further comprising the actuator that is provided with a slot for receiving the lock portion when the second lock member is in its projected configuration.

9. A gate latch assembly as claimed in claim 8, wherein when the lock portion is received in the slot, movement of the latch is limited in the direction of the latch's longitudinal axis.

10. A gate latch assembly as claimed in claim 8, wherein the slot is formed in a rib on the or one of the latch members.

11. A gate latch assembly as claimed in claim 10, wherein the latch member on which the rib is formed is provided with a guide surface to the slot for guiding the lock portion into the slot as the second lock member is brought into its projected configuration.

12. A gate latch assembly as claimed in claim 11, wherein the guide surface comprises a portion of an end surface of the rib.

13. A gate latch assembly as claimed in claim 11, wherein the guide surface is provided by a tapering of at least a portion of the rib towards the slot.

14. A gate latch assembly as claimed in claim 1, wherein the lock further comprises a lock status indicator which provides a visual indication of when the latch is locked in its latched condition.

15. A gate latch assembly as claimed in claim 14, wherein the lock status indicator is formed on the second lock member.

16. A gate latch assembly as claimed in claim 14, wherein the lock status indicator comprises the end surface of a projecting nose of the second lock member.

17. A gate latch assembly as claimed in claim 1, wherein the latching assembly comprises a housing for housing the lock.

18. A gate latch assembly as claimed in claim 17, wherein the housing and the second lock member have interengaging groove and rail formations which guide movement of the second lock member between its retracted and projecting configurations.

19. A gate latch assembly for a gate comprising:

a latch operative to adopt a latched condition, a lock movable into a locking condition to lock the latch in its latched condition, wherein the lock comprises a first lock member that is configured to rotate about its axis such that rotation of the first lock member causes lateral displacement of a second lock member to move into said locking condition to lock the latch; and a lock status indicator which provides a visual indication of when the latch is locked in its latched condition, the lock status indicator having an indicator portion that is moved from a retracted configuration to a projected configuration by the movement of the second lock member to its locking condition, whereby the indicator portion when in its projected configuration provides the visual indication that the latch is locked in its latched condition, wherein the lock status indicator is formed on the second lock member.

20. A gate latch assembly according to claim 18, wherein the lock member has a cam surface which engages the lock status indicator, whereby rotation of the lock member causes its cam surface to move the indicator portion into either its retracted or projected configuration.

* * * * *